US009135475B2

(12) United States Patent
Lecerf et al.

(10) Patent No.: US 9,135,475 B2
(45) Date of Patent: Sep. 15, 2015

(54) SYSTEM AND METHOD FOR PERFORMING DOWNHOLE STIMULATION OPERATIONS

(71) Applicant: Schlumberger Technology Corporation, Sugar Land, TX (US)

(72) Inventors: Bruno Lecerf, Houston, TX (US); Dmitriy Usoltsev, San Antonio, TX (US); Timothy L. Pope, Cheyenne, WY (US); Alejandro Pena, Katy, TX (US); Tarik Itibrout, Richmond, TX (US); Xiaowei Weng, Katy, TX (US); Hitoshi Onda, Houston, TX (US); Philippe Enkababian, Richmond, TX (US)

(73) Assignee: Sclumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 14/101,028

(22) Filed: Dec. 9, 2013

(65) Prior Publication Data

US 2014/0222405 A1 Aug. 7, 2014

Related U.S. Application Data

(63) Continuation-in-part of application No. 13/338,732, filed on Dec. 28, 2011, which is a continuation-in-part of application No. 11/936,344, filed on Nov. 7, 2007, now Pat. No. 8,412,500.

(Continued)

(51) Int. Cl.
*G06G 7/48* (2006.01)
*G06G 7/50* (2006.01)
(Continued)

(52) U.S. Cl.
CPC *G06G 7/50* (2013.01); *E21B 43/17* (2013.01); *E21B 43/26* (2013.01)

(58) Field of Classification Search
CPC ..... E21B 43/17
USPC ..... 703/10
See application file for complete search history.

(56) References Cited

U.S. PATENT DOCUMENTS 4,584,874 A 4/1986 Ruhovets
5,070,457 A 12/1991 Poulsen
(Continued)

FOREIGN PATENT DOCUMENTS

WO 2008093264 A1 8/2008
WO 2011077227 A2 6/2011

OTHER PUBLICATIONS

Wipo 5: search report PCT/IB2011/055998; three pages; 2012.*
(Continued)

*Primary Examiner* — Hugh Jones
(74) *Attorney, Agent, or Firm* — Mathieu Vandermolen; Rachel Greene; Tim Curington

(57) ABSTRACT

A system and method for performing stimulation operations at a wellsite having a subterranean formation with of a reservoir therein is provided. The method involves generating a plurality of quality indicators from a plurality of logs, and combining the plurality of quality indicators to form a composite quality indicator. The plurality of stress blocks may then be merged using diversion criterion. The composite quality indicator may be combined with the merged stress blocks to form a combined stress and composite quality indicator, the combined stress and composite quality indicator comprising a plurality of blocks with boundaries therebetween. The method may further comprise defining stages along the combined stress and composite quality indicator based on the diverter-assisted stage classifications; and selectively positioning perforations in select stages based on the diverter-assisted stage classifications thereon.

13 Claims, 24 Drawing Sheets

Related U.S. Application Data

(60) Provisional application No. 60/887,008, filed on Jan. 29, 2007, provisional application No. 61/464,134, filed on Feb. 28, 2011, provisional application No. 61/460,372, filed on Dec. 30, 2010.

(51) Int. Cl.
*E21B 43/17* (2006.01)
*E21B 43/26* (2006.01)

(56) References Cited

U.S. PATENT DOCUMENTS

| | | | | |
|---|---|---|---|---|
| 5,170,378 | A | 12/1992 | Mellor et al. | |
| 5,279,366 | A | 1/1994 | Scholes | |
| 6,508,307 | B1 | 1/2003 | Almaguer | |
| 6,853,921 | B2 * | 2/2005 | Thomas et al. | 702/14 |
| 6,876,959 | B1 | 4/2005 | Peirce et al. | |
| 6,980,940 | B1 * | 12/2005 | Gurpinar et al. | 703/10 |
| 7,714,741 | B2 | 5/2010 | Snider et al. | |
| 7,908,230 | B2 | 3/2011 | Bailey et al. | |
| 7,925,482 | B2 | 4/2011 | Kennon et al. | |
| 8,439,116 | B2 | 5/2013 | East, Jr. et al. | |
| 2002/0120429 | A1 | 8/2002 | Ortoleva | |
| 2005/0216198 | A1 | 9/2005 | Craig | |
| 2005/0234648 | A1 | 10/2005 | Economides et al. | |
| 2005/0284637 | A1 | 12/2005 | Stegent et al. | |
| 2006/0015310 | A1 | 1/2006 | Husen et al. | |
| 2006/0102345 | A1 | 5/2006 | McCarthy et al. | |
| 2006/0224370 | A1 | 10/2006 | Siebrits et al. | |
| 2006/0272860 | A1 | 12/2006 | Sweatman et al. | |
| 2007/0102155 | A1 | 5/2007 | Chan et al. | |
| 2007/0156377 | A1 * | 7/2007 | Gurpinar et al. | 703/10 |
| 2007/0272407 | A1 | 11/2007 | Lehman et al. | |
| 2007/0294034 | A1 | 12/2007 | Bratton et al. | |
| 2008/0066909 | A1 | 3/2008 | Hutchins et al. | |
| 2008/0081771 | A1 | 4/2008 | Lin et al. | |
| 2008/0087428 | A1 | 4/2008 | Symington et al. | |
| 2008/0093073 | A1 | 4/2008 | Bustos et al. | |
| 2008/0133186 | A1 | 6/2008 | Li et al. | |
| 2008/0176770 | A1 | 7/2008 | Sanders et al. | |
| 2008/0183451 | A1 | 7/2008 | Weng et al. | |
| 2008/0190603 | A1 | 8/2008 | Brannon | |
| 2009/0187391 | A1 | 7/2009 | Wendt et al. | |
| 2010/0307755 | A1 | 12/2010 | Xu et al. | |
| 2011/0060572 | A1 | 3/2011 | Brown et al. | |
| 2011/0120702 | A1 | 5/2011 | Craig | |
| 2011/0120705 | A1 | 5/2011 | Walters et al. | |
| 2011/0120718 | A1 | 5/2011 | Craig | |
| 2011/0125471 | A1 | 5/2011 | Craig et al. | |
| 2011/0125476 | A1 | 5/2011 | Craig | |
| 2011/0247824 | A1 | 10/2011 | Gu | |
| 2011/0257944 | A1 | 10/2011 | Du et al. | |
| 2012/0179444 | A1 | 7/2012 | Ganguly et al. | |
| 2012/0185225 | A1 | 7/2012 | Onda et al. | |
| 2012/0285692 | A1 | 11/2012 | Potapenko et al. | |

OTHER PUBLICATIONS

Wipo 2: search report PCT/IB2011/055998; one page; 2012.*

Wipo 3: search report PCT/IB2008/050259; three pages; date unknown.*

Wipo 4: search report PCT/IB2010/051458; four pages; date unknown.*

Saputelli et al.: Promoting Real-Time Optimization of Hydrocarbon Producing Systems; SPE 83978; pp. 1-9, 2003.*

Bailey et al.; Field Optimization Tool for Maximizing Asset Value; SPE 87026; 2004; pp. 1-10.*

Reservoir Stimulation, edited by Michael J. Economides and Kenneth G. Nolte, published by John Wiley & Sons, Ltd, Chichester, West Sussex, UK. ISBN—0 471 49192 6, 2000. 807 pages.*

Alekseyenko, et al., "Certain Aspects of a Two-Dimensional Problem on the Hydraulic Fracturing of an Elastic Medium", Journal of Mining Science, 1999, pp. 269-275.

Brown, J.E. et al., "Horizontal Advisor—The Key to Maximizing Horizontal Production", Reservoir Symposium 2007, Schlumberger, 2007, pp. 1-10.

Cipolla, et al., "Hydraulic Fracture Monitoring to Reservoir Simulation: Maximizing Value", SPE 133877—SPE Annual Technical Conference and Exhibition, Florence, Italy, Sep. 19-22, 2010, pp. 1-26.

Cipolla, et al., "Integrating Microseismic Mapping and Complex Fracture Modeling to Characterize Hydraulic Fracture Complexity", SPE 140185—SPE Hydraulic Fracturing Technology Conference, The Woodlands, Texas, 2011, pp. 1-22.

Cipolla, et al., "New Algorithms and Integrated Workflow for Tight Gas and Shale Completions", SPE 146872—SPE Annual Technical Conference and Exhibition, Denver, Colorado, 2011, pp. 1-18.

Cipolla, et al., "Seismic-to-Simulation for Unconventional Reservoir Development", SPE 146876—SPE Reservoir Characterization and Simulation Conference and Exhibition, Oct. 2011, pp. 1-23.

Cohen, et al., "Production Forecast after Hydraulic Fracturing in Naturally Fractured Reservoirs: Coupling a Complex Fracturing Simulator and a Semi-Analytical Production Model", SPE 152541—SPE Hydraulic Fracturing Technology Conference, Feb. 2012, pp. 1-19.

Daboul, B. et al., "Verbesserung Der Produktionsvorhersage Von Gefracten Gasbohrungen Durch Simulation =Improved Production Forecast of Fractured Gas Wells by 3D-Reservoir Simulation", Erdoel Erdgas Kohl, vol. 112(2); English Abstract, abstract only.

Fisher, et al., "Integrating Fracture Mapping Technologies to Optimize Stimulations in the Barnett Shale", SPE 77441—SPE Annual Technical Conference and Exhibition, 2002, pp. 1-7.

Gu, et al., "Hydraulic Fracture Crossing Natural Fracture at Non-Orthogonal Angles, A Criterion, Its Validation and Applications", SPE 139984—SPE Hydraulic Fracturing Technology Conference, Jan. 2011, pp. 1-11.

Hongron, et al., "3D Numerical Simulation of Hydraulic Fracture Closure with Application to Minifracture Analysis", SPE 20657—Journal of Petroleum Technology, vol. 45 (3), 1993, pp. 206-211, 255.

Jochen, et al., "Production Data Analysis: Unraveling Reservoir Quality and Completion Quality", SPE 147535—Canadian Unconventional Quality and Completion Quality, Nov. 2011, pp. 1-12.

Johnson, R.L., "Large-Volume, High-Rate Stimulation Treatments in Horizontal Wells in the Niobrara Formation, Silo Field, Laramie County, Wyoming", SPE 25926—Society of Petro-leum Engineers; Presented at SPE Rocky Mountain Regional/Low Permeability Reservoirs Symposium, Apr. 1993, pp. 781-794.

Kresse, et al., "Numerical Modeling of Hydraulic Fracturing in Naturally Fractured Formations", 45th U.S. Rock Mechanics/Geomechanics Symposium, Jun. 2011, pp. 1-11.

Nagel, et al., "Stress Shadowing and Microseismic Events: A Numerical Evaluation", SPE 147363—SPE Annual Technical Conference and Exhibition, Denver, Colorado, 2011, 21 pp.

Ramakrishnan, et al., "Real-Time Completion Optimization of Multiple Laterals in Gas Shale Reservoirs; Integration of Geology, Log, Surface Seismic, and Microseismic Information", SPE 140542—SPE Hydraulic Fracturing Technology Conference, Jan. 2011, pp. 1-15.

Siebrits, E. et al., "Refracture Reorientation Enhances Gas Production in Barnett Shale Tight Gas Wells", Society of Petroleum Engineers, SPE 63030, Presented at 2000 SPE Annual Technical conference and Exhibition in Dallas, TX, Oct. 1-4, 2000, 7 pp.

Soliman, et al., "Fracturing Design aimed at Enhancing Fracture Complexity", SPE 130043—SPE EUROPEC/EAGE Annual Conference and Exhibition, Barcelona, Spain, Jun. 14-17, 2010, pp. 1-20.

Valencia, et al., "Optimizing Stimulation of Coalbed Methane Reservoirs Using an Integrated Fracture Modeling Approach", SPE 93245—Presented at Asia Pacific Oil and Gas Conference Exhibition, Jakarta, Indonesia, Apr. 5-7, 2005, 7 pp.

Weng, et al., "Effect of Production-Induced Stress Field on Refracture Propagation and Pressure Response", SPE 106043—SPE Hydraulic Fracturing Technology Conference in College Station, Texas, Jan. 29-31, 2007, 9 pp.

(56) References Cited

OTHER PUBLICATIONS

Weng, et al., "Modeling of Hydraulic-Fracture-Network Propagation in a Naturally Fractured Formation", SPE 140253—SPE Hydraulic Fracturing Technology Conference, The Woodlands, Texas, Jan. 24-26, 2011, 13 pp.

Wu, et al., "Modeling of Interaction of Hydraulic Fractures in Complex Fracture Networks", SPE 152052—SPE Hydraulic Fracturing Technology Conference, Feb. 2012, pp. 1-14.

Xu, et al., "Characterization of aHydraulically-Induced Fracture Network Using Treatment and Microseismic Data in a Tight-Gas Sand Formation: A Geomechanical Approach", SPE 125237, SPE Tight Gas Completions Conference, Jun. 2009, pp. 1-5.

Xu, et al., "Wiremesh: A Novel Shale Fracturing Simulator", SPE 132218—International Oil and Gas Conference, Jun. 2010, pp. 1-6.

International Search Report issued in PCT/IB2008/050259 on Jun. 24, 2008, 8 pages.

International Search Report issued in PCT/IB2011/055997 on Aug. 7, 2012, 10 pp.

* cited by examiner

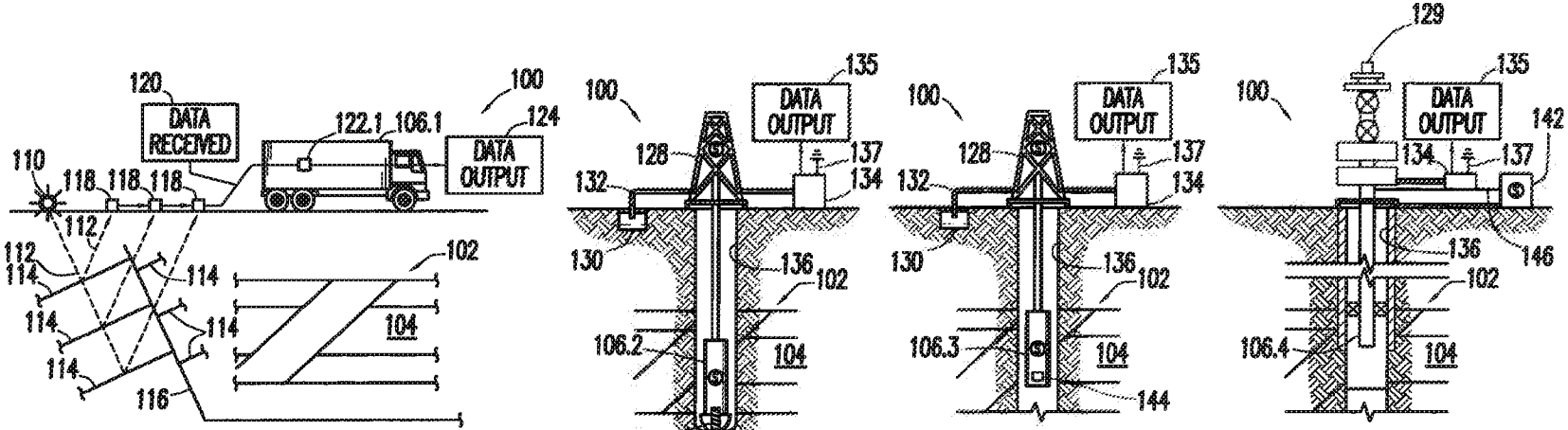
FIG.1.1
FIG.1.2
FIG.1.3
FIG.1.4
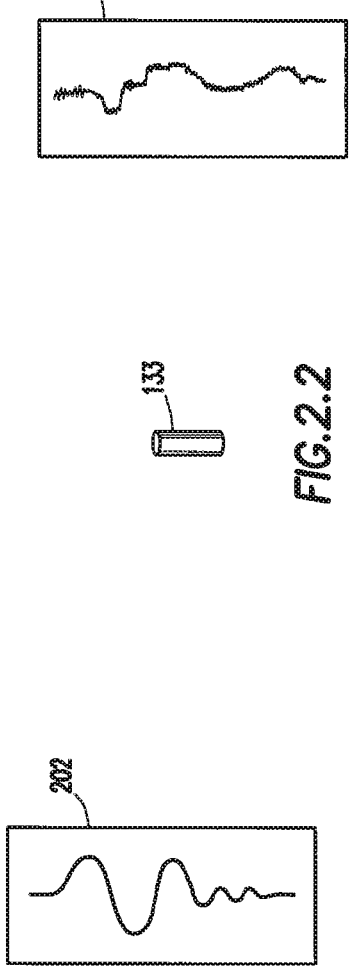
FIG.2.1
FIG.2.2
FIG.2.3
FIG.2.4

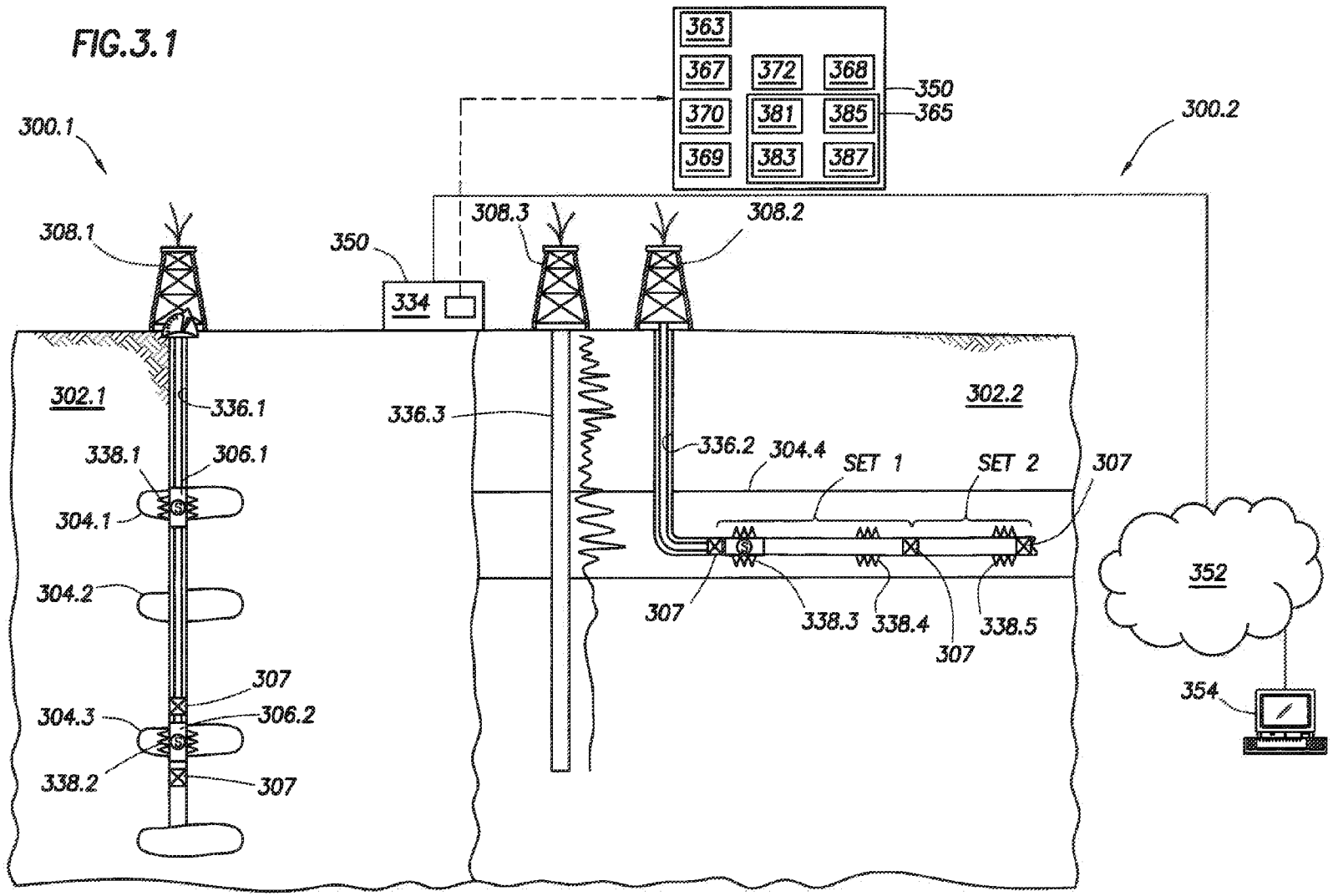
FIG.3.1

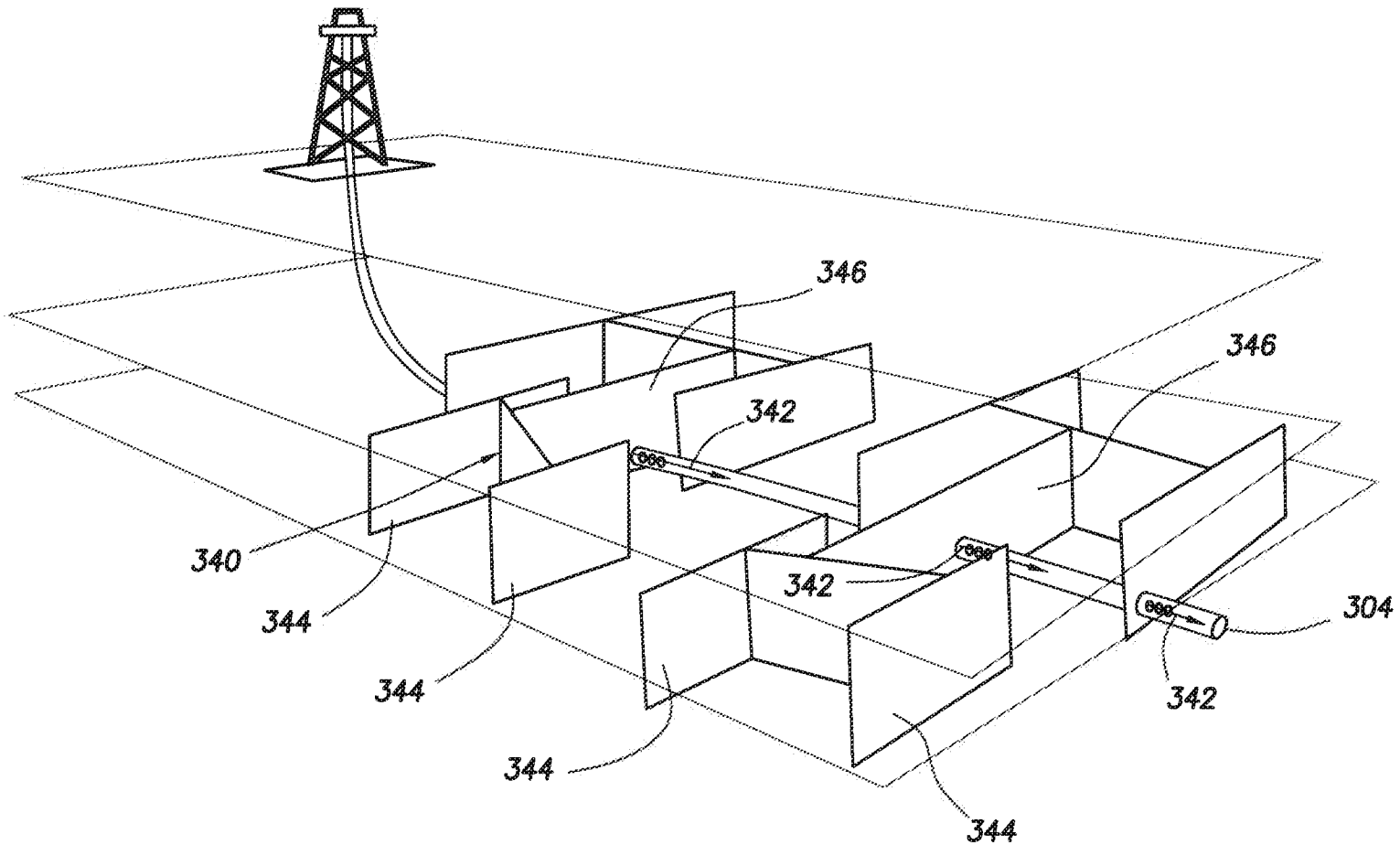
FIG.3.2

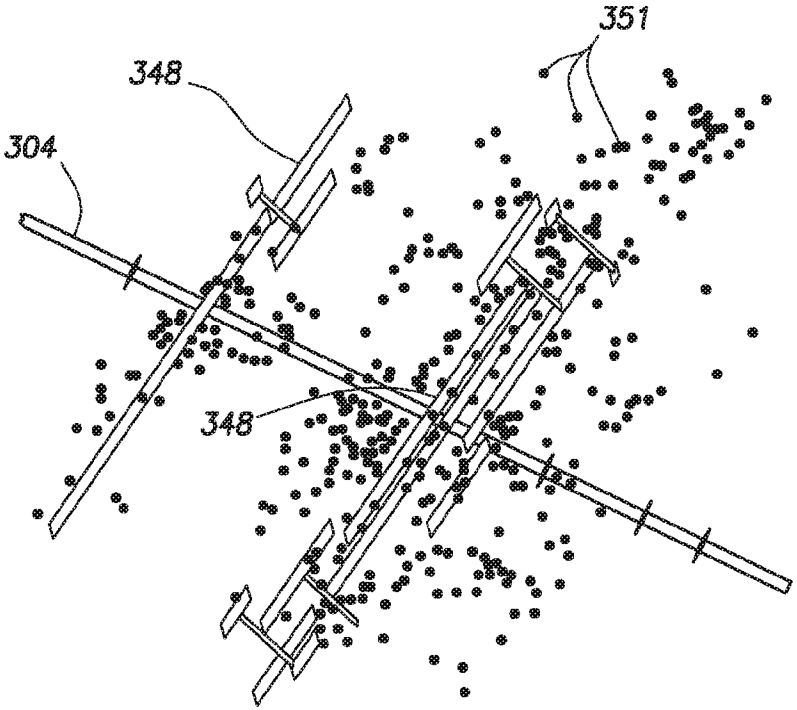
FIG.3.4
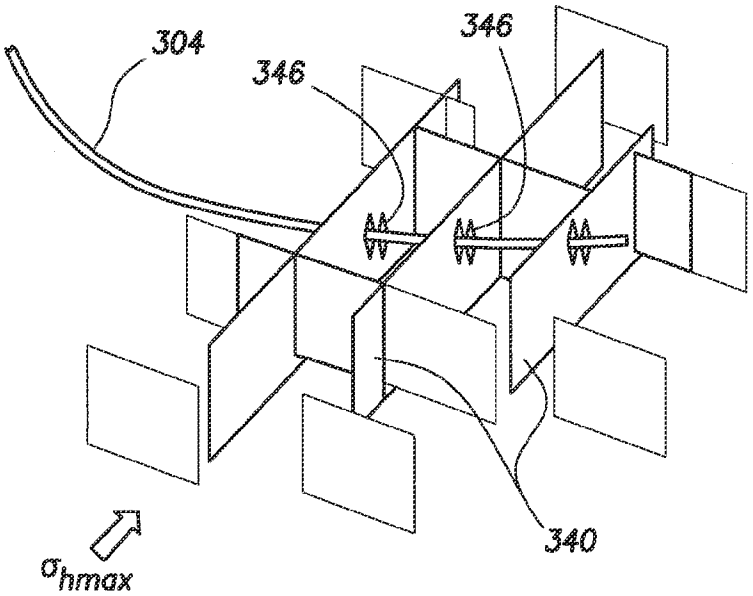
FIG.3.3

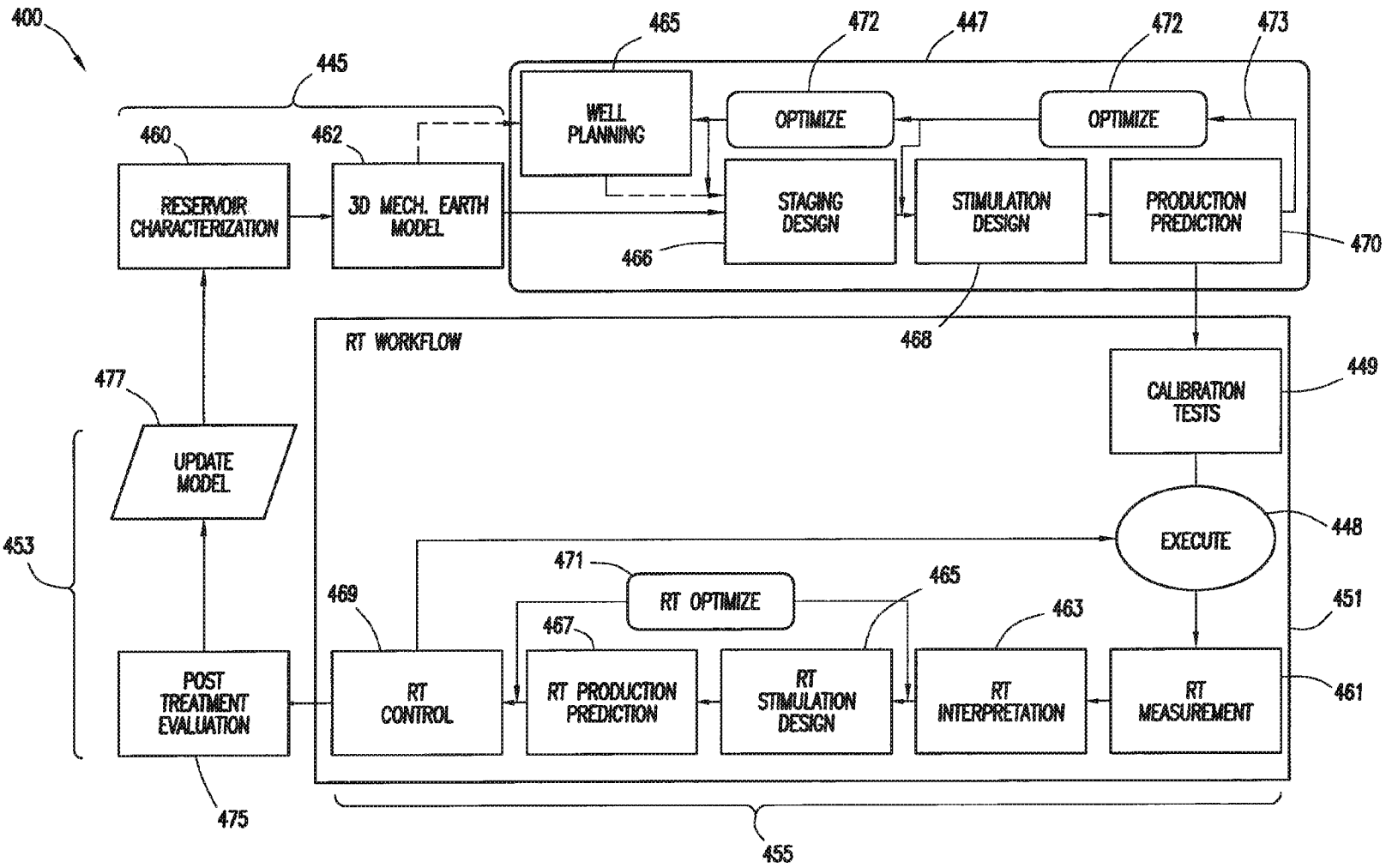
FIG. 4.1

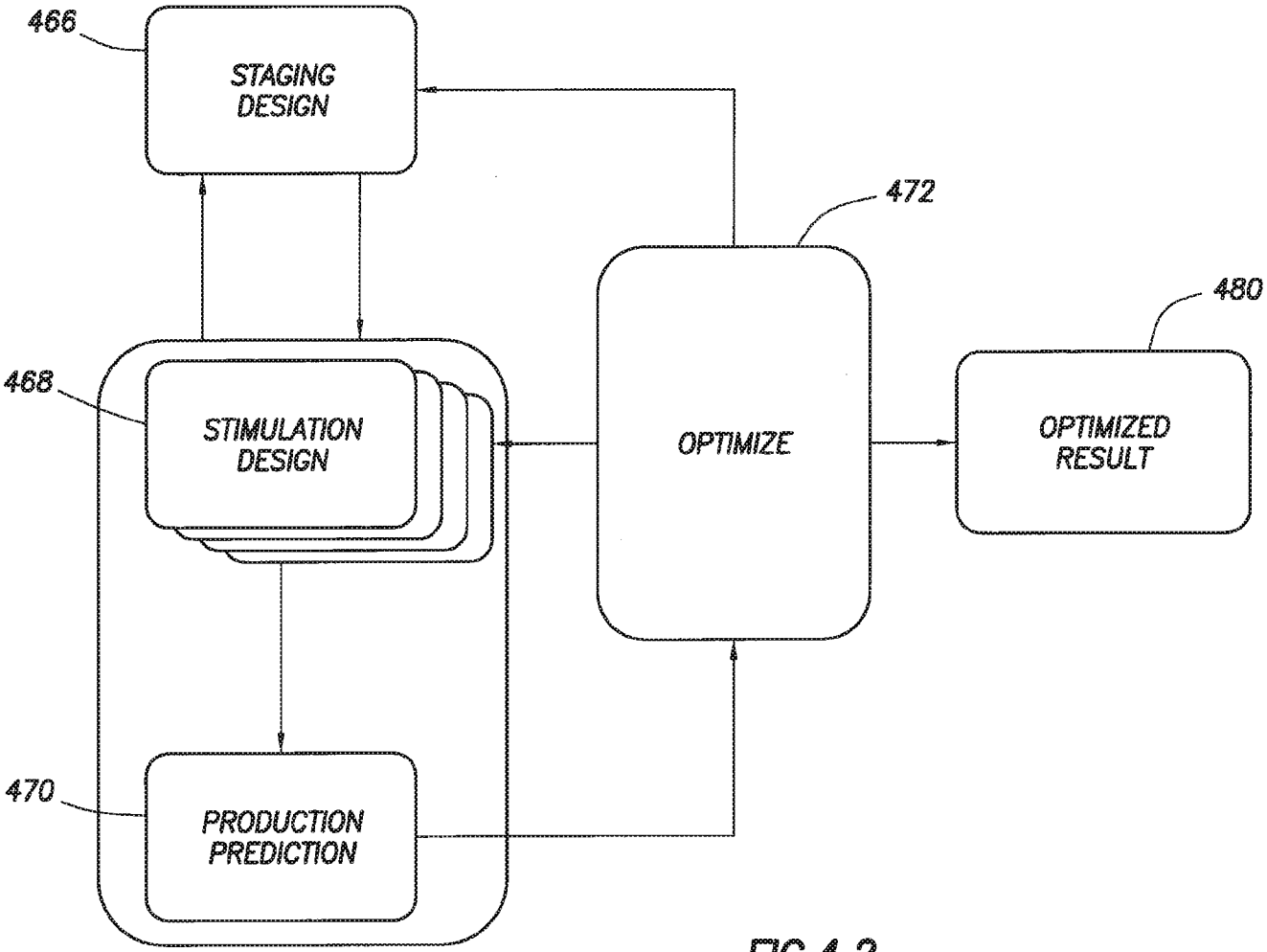
FIG. 4.2

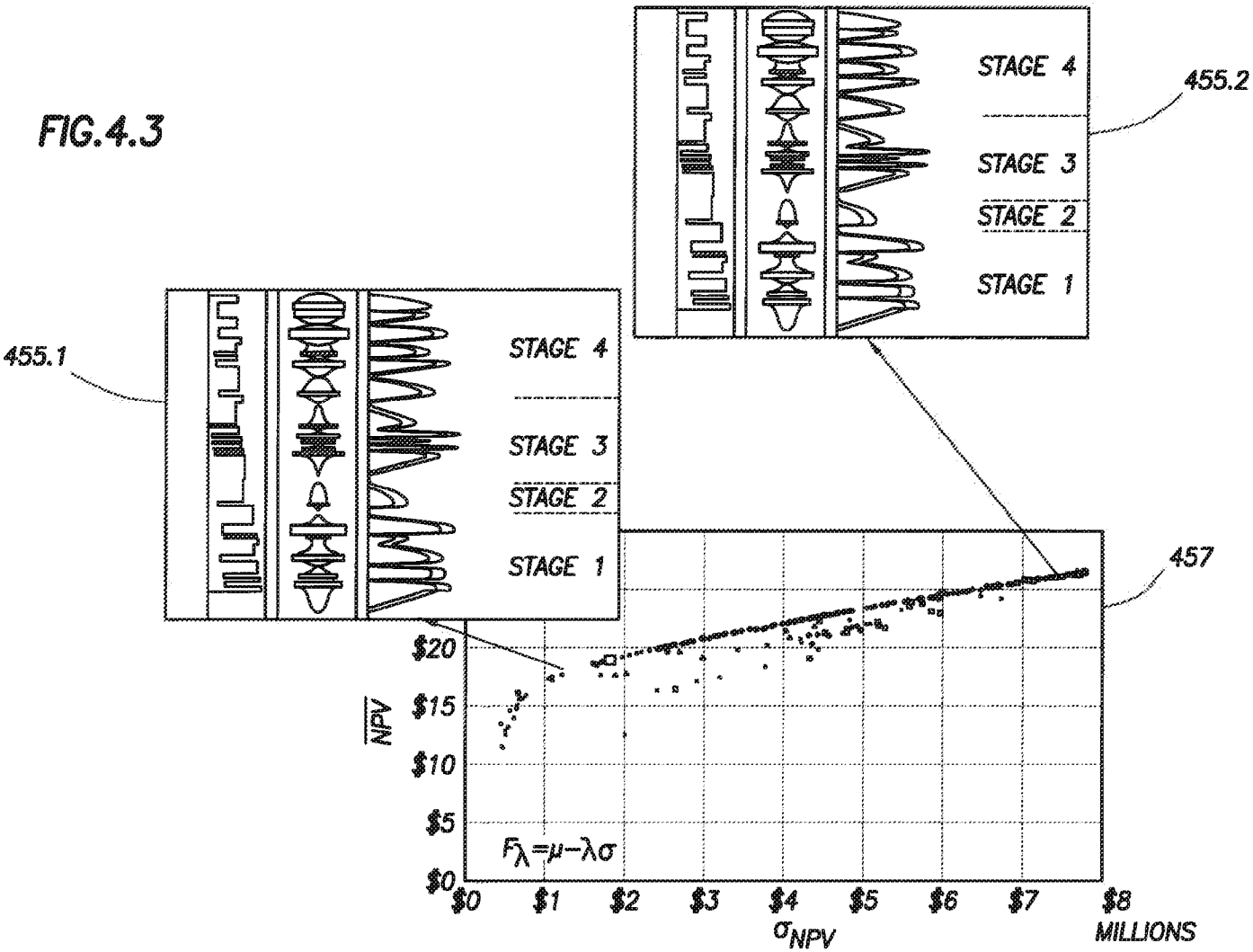
FIG. 4.3

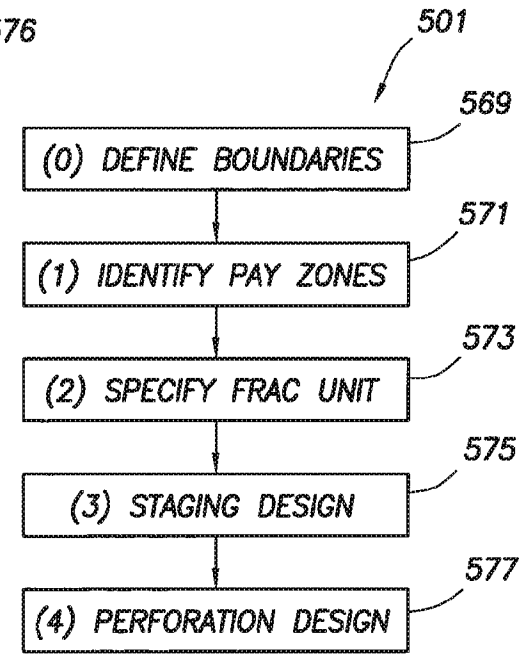
FIG.5.2
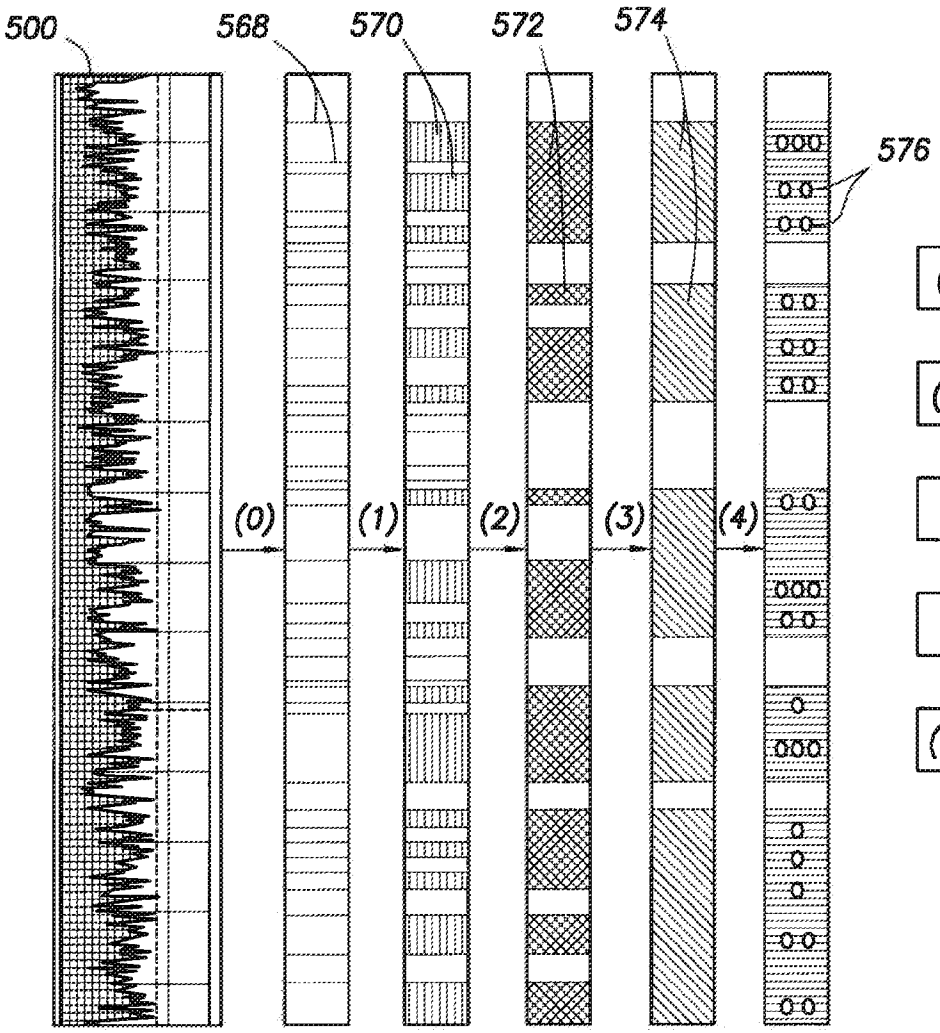
FIG.5.1

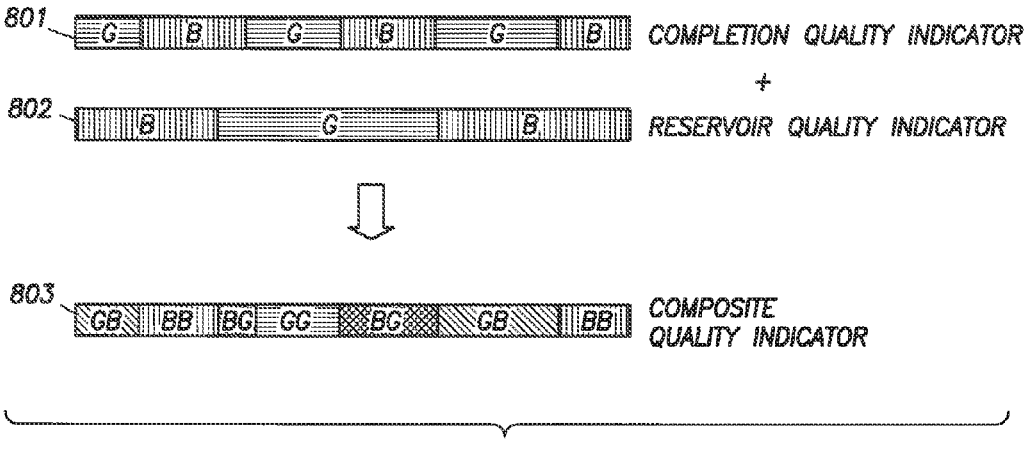
FIG.8
FIG.9
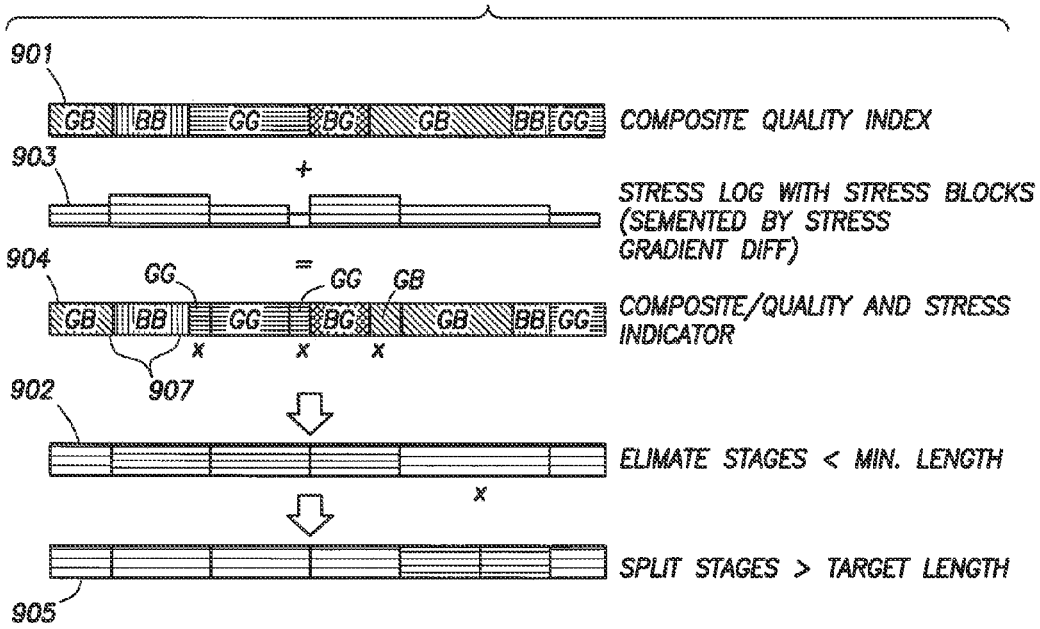

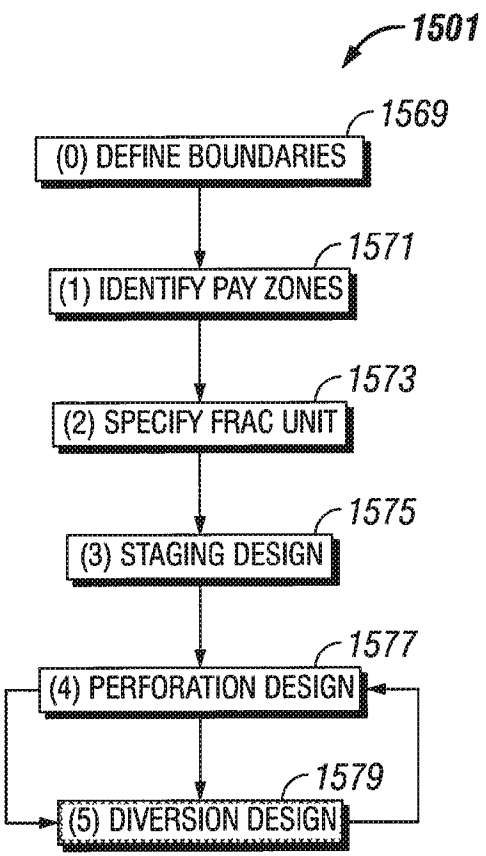
FIG. 15.2
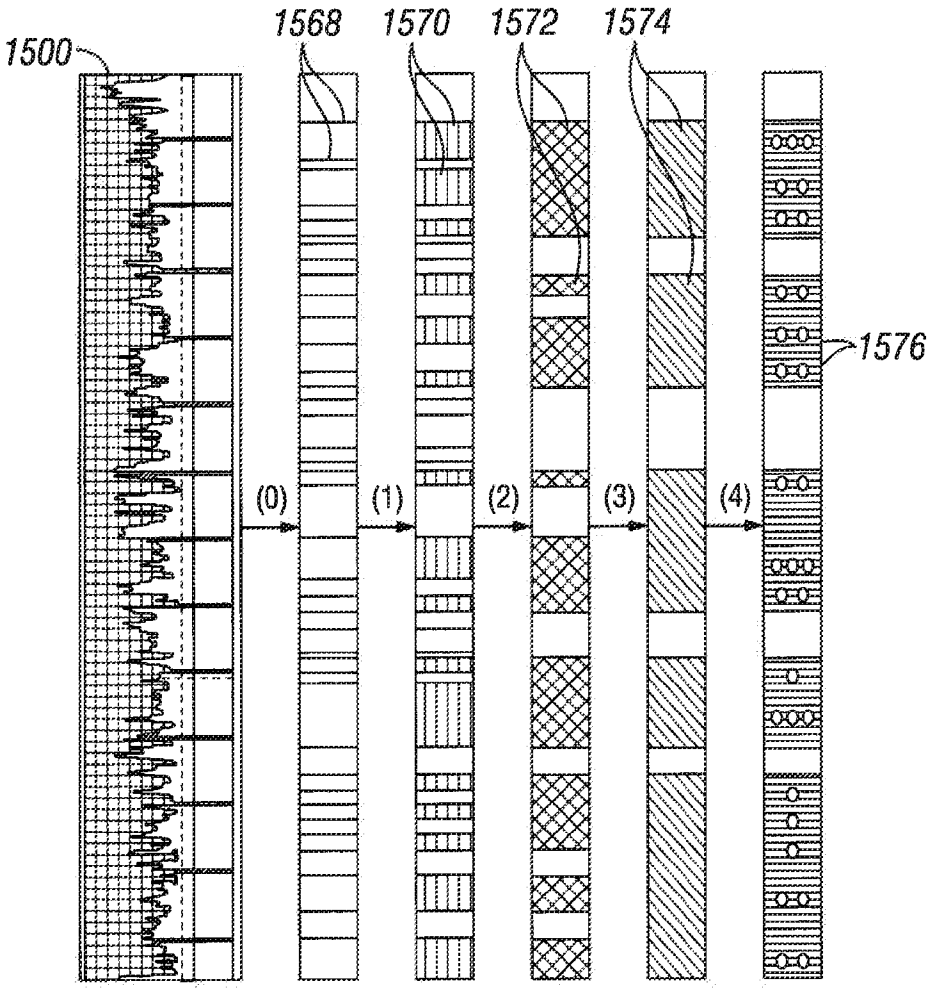
FIG. 15.1

SYSTEM AND METHOD FOR PERFORMING DOWNHOLE STIMULATION OPERATIONS

CROSS-REFERENCE TO RELATED APPLICATIONS

This application is a continuation-in-part of, and claims the benefit of priority to, U.S. Patent Application Pub. No. 2012/0185225, filed on Dec. 28, 2011, and entitled SYSTEM AND METHOD FOR PERFORMING DOWNHOLE STIMULATION OPERATIONS, which claims priority to U.S. Pat. No. 8,412,500, issued on Apr. 2, 2013, and entitled SIMULATIONS FOR HYDRAULIC FRACTURING TREATMENTS AND METHODS OF FRACTURING NATURALLY FRACTURED FORMATION, which claims priority to U.S. Provisional Application No. 60/887,008, filed on Jan. 29, 2007, and entitled METHOD FOR HYDRAULIC FRACTURING TREATMENT IN NATURALLY FRACTURED FORMATION; this application also claims benefit of priority to U.S. Provisional Application No. 61/464,134, filed on Feb. 28, 2011, and U.S. Provisional Application No. 61/460,372, filed on Dec. 30, 2010, entitled INTEGRATED RESERVOIR CENTRIC COMPLETION AND STIMULATION DESIGN METHODS; the entire contents of each are hereby incorporated by reference herein in their entirety.

BACKGROUND

The present disclosure relates to techniques for performing oilfield operations. More particularly, the present disclosure relates to techniques for performing stimulation operations, such as perforating, injecting, and/or fracturing, a subterranean formation having at least one reservoir therein. The statements in this section merely provide background information related to the present disclosure and may not constitute prior art.

Oilfield operations may be performed to locate and gather valuable downhole fluids, such as hydrocarbons. Oilfield operations may include, for example, surveying, drilling, downhole evaluation, completion, production, stimulation, and oilfield analysis. Surveying may involve seismic surveying using, for example, a seismic truck to send and receive downhole signals. Drilling may involve advancing, a downhole tool into the earth to form a wellbore. Downhole evaluation may involve deploying a downhole tool into the wellbore to take downhole measurements and/or to retrieve downhole samples. Completion may involve cementing and casing a wellbore in preparation for production. Production may involve deploying production casing into the wellbore for transporting fluids from a reservoir to the surface. Stimulation may involve, for example, perforating, fracturing, injecting, and/or other stimulation operations, to facilitate production of fluids from the reservoir.

Oilfield analysis may involve, for example, evaluating information about the wellsite and the various operations, and/or performing well planning operations. Such information may be, for example, petrophysical information gathered and/or analyzed by a petrophysicist; geological information gathered and/or analyzed by a geologist; or geophysical information gathered and/or analyzed by a geophysicist. The petrophysical, geological and geophysical information may be analyzed separately with dataflow therebetween being, disconnected. A human operator may manually move and analyze the data using multiple software and tools. Well planning may be used to design oilfield operations based on information gathered about the wellsite.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The techniques disclosed herein relate to stimulation operations involving staging design. In an exemplary embodiment of the present disclosure, the method may involve generating a plurality of quality indicators from a plurality of logs, and combining the plurality of quality indicators to form a composite quality indicator. The composite quality indicator may be combined with a stress log to form a combined stress and composite quality indicator, the combined stress and composite quality indicator comprising a plurality of blocks with boundaries therebetween. The method may further comprise identifying classifications for the plurality of blocks; defining stages along the combined stress and composite quality indicator based on the classifications; and selectively positioning perforations in select stages based on the classifications thereon.

BRIEF DESCRIPTION OF THE DRAWINGS

Embodiments of the method and system for performing a downhole stimulation operation are described with reference to the following figures. Like reference numerals are intended to refer to similar elements for consistency. For purposes of clarity, not every component may be labeled in every drawing.

FIGS. 1.1-1.4 are schematic views illustrating various oilfield operations at a wellsite;

FIGS. 2.1-2.4 are schematic views of data collected by the operations of FIGS. 1.1-1.4.

FIG. 3.1 is a schematic view of a wellsite illustrating various downhole stimulation operations.

FIGS. 3.2-3.4 are schematic views of various fractures of the wellsite of FIG. 3.1.

FIG. 4.1 is a schematic flow diagram depicting a downhole stimulation operation.

FIGS. 4.2 and 4.3 are schematic diagrams depicting portions of the downhole stimulation operation.

FIG. 5.1 is a schematic diagram and FIG. 5.2 is a flow chart illustrating a method of staging a stimulation operation in a tight gas sandstone formation.

FIG. 8 is a schematic diagram depicting a composite quality indicator termed from a completion and a reservoir quality indicator.

FIG. 9 is a schematic diagram depicting a stage design based on a stress profile and a composite quality indicator.

FIG. 15.1 is a schematic diagram and FIG. 15.2 is a flow chart illustrating a method of staging a stimulation operation in a tight gas sandstone formation with a diverter.

DETAILED DESCRIPTION

Figure 6:
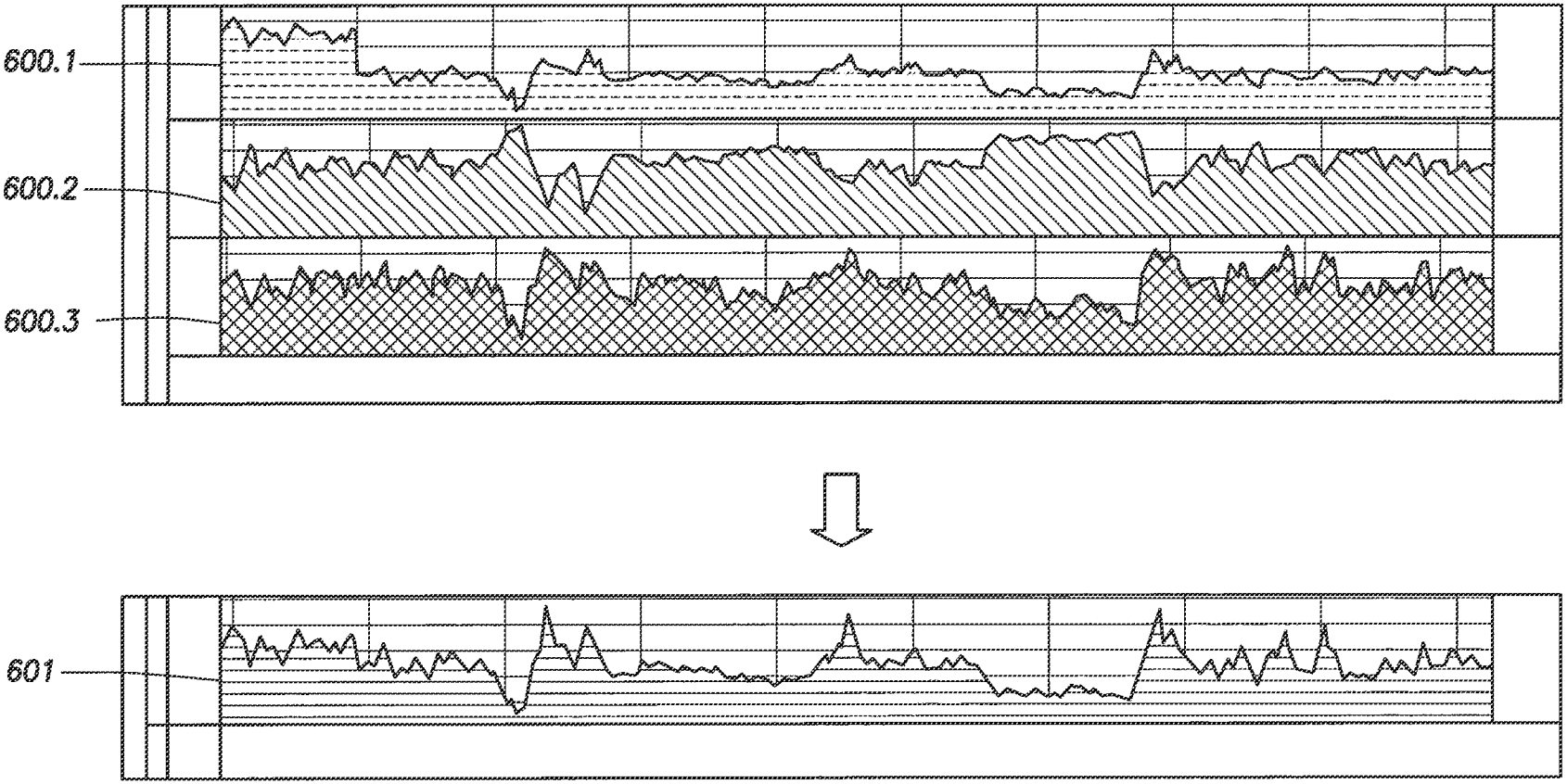
FIG. 6 is a schematic diagram depicting a set of logs combined to form a weighted composite log.

The description that follows includes exemplary systems, apparatuses, methods, and instruction sequences that embody techniques of the subject matter herein. However, it is understood that the described embodiments may be practiced without these specific details.

The present disclosure relates to design, implementation and feedback of stimulation operations performed at is wellsite. The stimulation operations may be performed using a reservoir centric, integrated approach. These stimulation operations may involve integrated stimulation design based on multi-disciplinary information (e.g., used by a petrophysicist, geologist, geomechanicist, geophysicist and reservoir engineer), multi-well applications, and/or multi-stage oilfield operations (e.g., completion, stimulation, and production). Some applications may be tailored to unconventional wellsite applications (e.g., tight gas, shale, carbonate, coal, etc.), complex wellsite applications multi-well), and various fracture models (e.g., conventional planar bi-wing fracture models for sandstone reservoirs or complex network fracture models for naturally fractured low permeability reservoirs), and the like. As used herein unconventional reservoirs relate to reservoirs, such as tight gas, sand, shale, carbonate, coal, and the like, where the formation is not uniform or is intersected by natural fractures (all other reservoirs are considered conventional).

The stimulation operations may also be performed using optimization, tailoring for specific types of reservoirs (e.g., tight gas, shale, carbonate, coal, etc.), integrating, evaluations criteria (e.g., reservoir and completion criteria), and integrating data from multiple sources. The stimulation operations may be performed manually using conventional techniques to separately analyze dataflow with separate analysis being disconnected and/or involving a human operator to manually move data and integrate data using multiple software and toots. These stimulation operations may also be integrated, for example, streamlined by maximizing multi-disciplinary data in an automated or semi-automated manner.

Oilfield Operations

FIGS. 1.1-1.4 depict various oilfield operations that may be performed at a wellsite, and FIGS. 2.1-2.4 depict various information that may be collected at the wellsite. FIGS. 1.1-1.4 depict simplified, schematic views of a representative oilfield or wellsite 100 having subsurface formation 102 containing, for example, reservoir 104 therein and depicting various oilfield operations being performed on the website 100. FIG. 1.1 depicts a survey operation being performed by a survey tool, such as seismic truck 106.1, to measure properties of the subsurface formation. The survey operation may be a seismic survey operation for producing sound vibrations. In FIG. 1.1, one such sound vibration 112 generated by a source 110 reflects off a plurality of horizons 114 in an earth formation 116. The sound vibration(s) 112 may be received in by sensors, such as geophone-receivers 118, situated on the earth's surface, and the geophones 118 produce electrical output signals, referred to as data received 120 in FIG. 1.1.

In response to the received sound vibration(s) 112 representative of different parameters (such as amplitude and/or frequency) of the sound vibration(s) 112, the geophones 118 may produce electrical output signals containing data concerning the subsurface formation. The data received 120 may be provided as input data to is computer 122.1 of the seismic truck 106.1, and responsive to the input data, the computer 122.1 may generate a seismic and microseismic data output 124. The seismic data output 124 may be stored, transmitted or further processed as desired, for example by data reduction.

FIG. 1.2 depicts a drilling operation being performed by a drilling tool 106.2 suspended by a rig 128 and advanced into the subsurface formations 102 to form a wellbore 136 or other channel. A mud pit 130 may be used to draw drilling mud into the drilling tools via flow line 132 for circulating drilling mud through the drilling tools, up the wellbore 136 and back to the surface. The drilling mud may be filtered and returned to the mud pit. A circulating system may be used for storing, controlling or filtering the flowing drilling muds. In this illustration, the drilling tools are advanced into the subsurface formations to reach reservoir 104. Each well may target one or more reservoirs. The drilling tools may be adapted for measuring downhole properties using, logging while drilling tools. The logging while drilling tool may also be adapted for taking a core sample 133 as shown, or removed so that a core sample may be taken using another tool.

A surface unit 134 may be used to communicate with the drilling tools and/or offsite operations. The surface unit may communicate with the drilling tools to send commands to the drilling tools, and to receive data therefrom. The surface unit may be provided with computer facilities for receiving, storing, processing, and/or analyzing data from the operation. The surface unit may collect data generated during the drilling operation and produce data output 135 which may be stored or transmitted. Computer facilities, such as those of the surface unit, may be positioned at various locations about the wellsite and/or at remote locations.

Sensors (S), such as gauges, may be positioned about the oilfield to collect data relating to various operations as described previously. As shown, the sensor (S) may be positioned in one or more locations in the drilling tools and/or at the rig to measure drilling parameters, such as weight on bit, torque on bit, pressures temperatures, flow rates, compositions, rotary speed and/or other parameters of the operation. Sensors (S) may also be positioned in one or more locations in the circulating system.

The data gathered by the sensors may be collected by the surface unit and/or other data collection sources for analysis or other processing. The data collected by the sensors may be used alone or in combination with other data. The data may be collected in one or more databases and/or transmitted on or offsite. All or select portions of the data may be selectively used for analyzing and/or predicting operations of the current and/or other wellbores. The data may be historical data, real time data or combinations thereof. The real time data may be used in real time, or stored for later use. The data may also be combined with historical data or other inputs for further analysis. The data may be stored in separate databases, or combined into a single database.

The collected data may be used to perform analysis, such as modeling operations. For example, the seismic data output may be used to perform geological, geophysical, and/or reservoir engineering analysis. The reservoir, wellbore, surface and/or processed data may be used to perform reservoir, wellbore, geological, and geophysical or other simulations. The data outputs from the operation may be generated directly from the sensors, or after some preprocessing or modeling. These data outputs may act as inputs for further analysis.

The data may be collected and stored at the surface unit 134. One or more surface units may be located at the wellsite, or connected remotely thereto. The surface unit may be a single unit, or a complex network of units used to perform the necessary data management functions throughout the oilfield. The surface unit may be a manual or automatic system. The surface unit 134 may be operated and/or adjusted by a user.

The surface unit may be provided with a transceiver 137 to allow communications between the surface unit and various portions of the current oilfield or other locations. The surface unit 134 may also be provided with or functionally connected to one or more controllers for actuating mechanisms at the wellsite 100. The surface unit 134 may they send command signals to the oilfield in response to data received. The surface unit 134 may receive commands via the transceiver or may itself execute commands to the controller. A processor may be provided to analyze the data (locally or remotely), make the decisions and/or actuate the controller. In this manner, operations may be selectively adjusted based on the data collected. Portions of the operation, such as controlling drilling, weight on bit, pump rates or other parameters, may be optimized based on the information. These adjustments may be made automatically based on computer protocol, and/or manually by an operator. In some cases, well plans may be adjusted to select optimum operating conditions, or to avoid problems.

FIG. 1.3 depicts a wireline operation being performed by a wireline tool 106.3 suspended by the rig 128 and into the wellbore 136 of FIG. 1.2. The wireline tool 106.3 may be adapted for deployment into a wellbore 136 for generating well logs, performing downhole tests and/or collecting samples. The wireline tool 106.3 may be used to provide another method and apparatus for performing a seismic survey operation. The wireline tool 106.3 of FIG. 1.3 may, for example, have an explosive, radioactive, electrical, or acoustic, energy source 144 that sends and/or receives electrical signals to the surrounding subsurface formations 102 and fluids therein.

The wireline tool 106.3 may be operatively connected to, for example, the geophones 118 and the computer 122.1 of the seismic truck 106.1 of FIG. 1.1. The wireline tool 106.3 may also provide data to the surface unit 134. The surface unit 134 may collect data generated during the wireline operation and produce data output 135 which may be stored or transmitted. The wireline tool 106.3 may be positioned at various depths in the wellbore to provide a survey or other information relating to the subsurface formation.

Sensors (S), such as gauges, may be positioned about the wellsite 100 to collect data relating to various operations as described previously. As shown, the sensor (S) is positioned in the wireline tool 106.3 to measure downhole parameters which relate to, for example porosity, permeability, fluid composition and/or other parameters of the operation.

FIG. 1.4 depicts a production operation being performed by a production tool 106.4 deployed from a production unit or Christmas tree 129 and into the completed wellbore 136 of FIG. 1.3 for drawing fluid from the downhole reservoirs into surface facilities 142. Fluid flows from reservoir 104 through perforations in the casing (not shown) and into the production tool 106.4 in the wellbore 136 and to the surface facilities 142 via a gathering network 146.

Sensors (S), such as gauges, may be positioned about the oilfield to collect data relating to various operations as described previously. As shown, the sensor (S) may be positioned in the production tool 106.4 or associated equipment, such as the Christmas tree 129, gathering network, surface facilities and/or the production facility, to measure fluid parameters, such as fluid composition, flow rates, pressures, temperatures, and/or other parameters of the production operation.

While only simplified wellsite configurations are shown, it will be appreciated that the oilfield or wellsite 100 may cover a portion of land, sea and/or water locations that hosts one or more wellsites. Production may also include injection wells (not shown) for added recovery or for storage of hydrocarbons, carbon dioxide, or water, for example. One or more gathering facilities may be operatively connected to one or more of the wellsites, for selectively collecting downhole fluids from the wellsite(s).

It should be appreciated that FIGS. 1.2-1.4 depict tools that can be used to measure not only properties of an oilfield, but also properties of non-oilfield operations, such as mines, aquifers, storage, and other subsurface facilities. Also, while certain data acquisition tools are depicted, it will be appreciated that various measurement tools (e.g., wireline, measurement while drilling (MWD), logging while drilling (LWD), core sample, etc.) capable of sensing parameters, such as seismic two-way travel time, density, resistivity, production rate, etc., of the subsurface formation and/or its geological formations may be used. Various sensors (S) may be located at various positions along the wellbore and/or the monitoring tools to collect and/or monitor the desired data. Other sources of data may also be provided from offsite locations.

The oilfield configuration of FIGS. 1.1-1.4 depict examples of a wellsite 100 and various operations usable with the techniques provided herein. Part, or all, of the oilfield may be on land, water and/or sea. Also, while a single oilfield measured at a single location is depicted, reservoir engineering may be utilized with any combination of one or more oilfields, one or more processing facilities, and one or more wellsites.

FIGS. 2.1-2.4 are graphical depictions of examples of data collected by the tools of FIGS. 1.1-1.4, respectively. FIG. 2.1 depicts a seismic trace 202 of the subsurface formation of FIG. 1.1 taken by seismic truck 106.1. The seismic trace may be used to provide data, such as a two-way response over a period of time. FIG. 2.2 depicts a core sample 133 taken by the drilling tools 106.2. The core sample may be used to provide data, such as a graph of the density, porosity, permeability or other physical property of the core sample over the length of the core. Tests for density and viscosity may be performed on the fluids in the core at varying, pressures and temperatures. FIG. 2.3 depicts a well log 204 of the subsurface formation of FIG. 1.3 taken by the wireline tool 106.3. The wireline log may provide a resistivity or other measurement of the formation at various depts. FIG. 2.4 depicts a production decline curve or graph 206 of fluid flowing through the subsurface formation of FIG. 1.4 measured at the surface facilities 142. The production decline curve may provide the production rate Q as a function of time t.

The respective graphs of FIGS. 2.1, 2.3, and 2.4 depict examples of static measurements that may describe or provide information about the physical characteristics of the formation and reservoirs contained therein. These measurements may be analyzed to define properties of the formation(s), to determine the accuracy of the measurements and/or to check for errors. The plots of each of the respective measurements may be aligned and scaled for comparison and verification of the properties.

FIG. 2.4 depicts an example of a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subsurface formation to determine characteristics thereof. Similar measurements may also be used to measure changes in formation aspects over time.

Stimulation Operations

FIG. 3.1 depicts stimulation operations performed at wellsites 300.1 and 300.2. The wellsite 300.1 includes as rig 308.1 having a vertical wellbore 336.1 extending into a formation 302.1. Wellsite 300.2 includes rig 308.2 having wellbore 336.2 and rig 308.3 having wellbore 336.3 extending therebelow into a subterranean formation 302.2. While the wellsites 300.1 and 300.2 are shown having specific configurations of rigs with wellbores, it will be appreciated that one or more rigs with one or more wellbores may be positioned at one or more wellsites.

Wellbore 336.1 extends from rig 308.1, through unconventional reservoirs 304.1-304.3. Wellbores 336.2 and 336.3 extend from rigs 308.2 and 308.3, respectfully to unconventional reservoir 304.4. As shown, unconventional reservoirs 304.1-304.3 are tight gas sand reservoirs and unconventional reservoir 304.4 is a shale reservoir. One or more unconventional reservoirs such as tight gas, shale, carbonate, coal, heavy oil, etc.) and/or conventional reservoirs may be present in a given formation.

The stimulation operations of FIG. 3.1 may be performed alone or in conjunction with other oilfield operations, such as the oilfield operations of FIGS. 1.1 and 1.4. For example, wellbores 336.1-336.3 may be measured, drilled, tested and produced as shown in FIGS. 1.1-1.4. Stimulation operations performed at the wellsites 300.1 and 300.2 may involve, for example, perforation, fracturing, injection, and the like. The stimulation operations may be performed in conjunction with other oilfield operations, such as completions and production operations (see, e.g., FIG. 1.4). As shown in FIG. 3.1, the wellbores 336.1 and 336.2 have been completed and provided with perforations 338.1-338.5 to facilitate production.

Downhole tool 306.1 is positioned in vertical wellbore 336.1 adjacent tight gas sand reservoirs 304.1 for taking downhole measurements. Packers 307 are positioned in the wellbore 336.1 for isolating a portion thereof adjacent perforations 338.2. Once the perforations are formed about the wellbore fluid may be injected through the perforations and into the formation to create and/or expand fractures therein to stimulate production from the reservoirs.

Reservoir 304.4 of formation 302.2 has been perforated and packers 307 have been positioned to isolate the wellbore 336.2 about the perforations 338.3-338.5. As shown in the horizontal wellbore 336.2, packers 307 have been positioned at stages $St_1$ and $St_2$ of the wellbore. As also depicted, wellbore 304.3 may be an offset (or pilot) well extended through the formation 302.2 to reach reservoir 304.4. One or more wellbores may be placed, at one or more wellsites. Multiple wellbores may be placed as desired.

Fractures may be extended into the various reservoirs 304.1-304.4 for facilitating production of fluids therefrom. Examples of fractures that may be formed are schematically shown in FIGS. 3.2 and 3.4 about a wellbore 304. As shown in FIG. 3.2, natural fractures 340 extend in layers about the wellbore 304. Perforations (or perforation clusters) 342 may be formed about the wellbore 304, and fluids 344 and/or fluids mixed with proppant 346 may be injected through the perforations 342. As shown in FIG. 3.3, hydraulic fracturing may be performed by injecting through the perforations 342, creating fractures along a maximum stress plane $\sigma_{lmax}$ and opening and extending the natural fractures.

FIG. 3.4 shows another view of the fracturing operation about the wellbore 304. In this view, the injected fractures 348 extend radially about the wellbore 304. The injected fractures may be used to reach the pockets of microseismic events 351 (shown schematically as dots) about the wellbore 304. The fracture operation may be used as part of the stimulation operation to provide pathways for facilitating movement of hydrocarbons to the wellbore 304 for production.

Referring back to FIG. 3.1, sensors (S), such as gauges, may be positioned about the oilfield to collect data relating to various operations as described previously. Some sensors, such as geophones, may be positioned about the formations during fracturing for measuring microseismic waves and performing microseismic mapping. The data gathered by the sensors may be collected by the surface unit 334 and/or other data collection sources for analysis or other processing as previously described (see, e.g., surface unit 134). As shown, surface unit 334 is linked to a network 352 and other computers 354.

A stimulation tool 350 may be provided as part of the surface unit 334 or other portions of the wellsite for performing stimulation operations. For example, information generated during one or more of the stimulation operations may be used in well planning for one or more wells, one or more wellsites and/or one or more reservoirs. The stimulation tool 350 may be operatively linked to one of more rigs and/or wellsites, and used to receive data, process data, send control signals, etc., as will be described, further herein. The stimulation tool 350 may include a reservoir characterization unit 363 for generating a mechanical earth model (MEM), a stimulation planning unit 365 for generating stimulation plans, an optimizer 367 for optimizing the stimulation plans, a real time unit 369 for optimizing in real time the optimized stimulation plan, a control unit 368 for selectively adjusting the stimulation operation based on the real time optimized stimulation plan, an updater 370 for updating the reservoir characterization model based on the real time optimized stimulation plan and post evaluation data, and a calibrator 372 for calibrating the optimized stimulation plan as will be described further herein. The stimulation planning unit 365 may include a staging design tool 381 for performing staging design, a stimulation design tool 383 for performing stimulation design, a production prediction tool 385 for prediction production and a well planning tool 387 for generating, well plans.

Wellsite data used in the stimulation operation may range from, for example, core samples to petrophysical interpretation based on well logs to three dimensional seismic data (see, e.g., FIGS. 2.1-2.4). Stimulation design may employ, for example, oilfield petrotechnical experts to conduct manual processes to collate different pieces of information. Integration of the information may involve manual manipulation of disconnected workflows and outputs, such as delineation of a reservoir zones, identification of desired completion zones, estimation of anticipated hydraulic fracture growth for a given completion equipment configurations, decision on whether and where to place another well or a plurality of wells for better stimulation of the formation, and the like. This stimulation design may also involve semi-automatic or automatic integration, feedback and control to facilitate the stimulation operation.

Stimulation operations for conventional and unconventional reservoirs may be performed based on knowledge of the reservoir. Reservoir characterization may be used, for example, in well planning, identifying optimal target zones for perforation and staging, design of multiple wells (e.g., spacing and orientation), and geomechanical models. Stimulation designs may be optimized based on a resulting production prediction. These stimulation designs may involve an integrated reservoir centric workflow which include design, real time (RT), and post treatment evaluation components. Well completion and stimulation design may be performed while making use of multi-disciplinary wellbore and reservoir data.

FIG. 4.1 is a schematic flow diagram 400 depicting a stimulation operation, such as those shown in FIG. 3.1. The flow diagram 400 is an iterative process that uses integrated information and analysis to design, implement and update a stimulation operation. The method involves pretreatment evaluation 445, a stimulation planning 447, real time treatment optimization 451, and design/model update 453. Part or all of the flow diagram 400 may be iterated to adjust stimulation operations and/or design additional stimulation operations in existing or additional wells.

The pre-stimulation evaluation 445 involves reservoir characterization 460 and generating a three-dimensional mechanical earth model (MEM) 462. The reservoir characterization 460 may be generated b integrating information, such as the information gathered in FIGS. 1.1-1.4, to perform modeling using united combinations of information from historically independent technical regimes or disciplines (e.g., petrophysicist, geologist, geomechanic and geophysicist, and previous fracture treatment results). Such reservoir characterization 460 may be generated using integrated static modeling techniques to generate the MEM 462 as described, for example, in US Patent Application Nos. 2009/0187391 and 2011/0660572. By way of example, software, such as PETREL™, VISAGE™, TECHLOG™, and GEOFRAME™ commercially available from SCHLUMBERGER™, may be used to perform the pre-treatment evaluation 445.

Reservoir characterization 460 may involve capturing a variety of information, such as data associated with the underground formation and developing one or more models of the reservoir. The information captured may include, for example, stimulation information, such as reservoir (pay) zone, geomechanical (stress) zone, natural fracture distribution. The reservoir characterization 460 may be performed such that information concerning the stimulation operation is included in pre-stimulation evaluations. Generating the MEM 462 may simulate the subterranean formation under development (e.g., generating a numerical representation of a state of stress and rock mechanical properties for a given stratigraphic section in an oilfield or basin).

Conventional geomechanical modeling may be used to generate the MEM 462. Examples of MEM techniques are provided in US Patent Application No. 2009/0187391. The MEM 462 may be generated by information gathered using, for example, the oilfield operations of FIGS. 1.1-1.4, 2.1-2.4 and 3. For example, the 3D MEM may take into account various reservoir data collected beforehand, including the seismic data collected during early exploration of the formation and logging data collected from the drilling of one or more exploration wells before production (see, e.g., FIGS. 1.1-1.4). The MEM 462 may be used to provide, for example, geomechanical information for various oilfield operations, such as casing point selection, optimizing thy number of casing strings, drilling stable wellbores, designing completions, performing fracture stimulation, etc.

The generated MEM 462 may be used as an input in performing stimulation planning 447. The 3D MEM may be constructed to identify potential drilling wellsites. In one embodiment, when the formation is substantially uniform and is substantially free of major natural fractures and/or high-stress barriers, it can be assumed that a given volume of fracturing fluid pumped at a given rate over a given period of time will generate a substantially identical fracture network in the formation. Core samples, such as those shown in FIGS. 1.2 and 2.2 may provide information useful in analyzing fracture properties of the formation. For regions of the reservoir manifesting similar properties, multiple wells tar branches) can be placed at a substantially equal distance from one another and the entire formation will be sufficiently stimulated.

The stimulation planning 447 may involve well planning 465, staging design 466, stimulation design, 468 and production prediction 470. In particular, the MEM 462 may be an input to the well planning 465 and/or the staging design 466 and stimulation design 468. Some embodiments may include semi automated methods to identify, for example, well spacing and orientation, multistage perforation design and hydraulic fracture design. To address a wide variation of characteristics in hydrocarbon reservoirs, some embodiments may involve dedicated methods per target reservoir environments, such as, but not limited to, tight gas formations, sandstone reservoirs, naturally fractured shale reservoirs, or other unconventional reservoirs.

The stimulation planning 447 may involve a semi-automated method used to identify potential drilling wellsites by partitioning underground formations into multiple set of discrete intervals, characterizing each interval based on information such as the formation's geophysical properties and its proximity to natural fractures, then regrouping multiple intervals into one or multiple drilling wellsites, with each wellsite receiving a well or a branch of a well. The spacing and orientation of the multiple wells may be determined and used in optimizing production of the reservoir. Characteristics of each well may be analyzed for stage planning and stimulation planning, in some cases, a completion advisor may be provided, for example, for analyzing vertical or near vertical wells in tight-gas sandstone reservoir following a recursive refinement workflow.

Well planning 465 may be performed to design oilfield operations in advance of performing such oilfield operations at the wellsite. The well planning 465 may be used to define, for example, equipment and operating parameters for performing the oilfield operations. Some such operating parameters may include, for example, perforating locations, operating pressures, stimulation fluids, and other parameters used in stimulation. Information gathered from various sources, such as historical data, known data, and oilfield measurements (e.g., those taken in FIGS. 1.1-1.4), may be used in designing a web plan. In some cases, modeling may be used to analyze data used in forming a well plan. The web plan generated in the stimulation planning may receive inputs from the staging design 466, stimulation design 468, and production prediction 470 so that information relating to and/or affecting stimulation is evaluated in the well plan.

The well planning 405 and/or MEM 402 may also be used as inputs into the staging design 466. Reservoir and other data may be used in the staging design 466 to define certain operational parameters for stimulation. For example, staging design 466 may involve defining boundaries in a wellbore for performing stimulation operations as described further herein. Examples of staging design are described in US Patent Application No. 2011/0247824. Staging design may be an input for performing stimulation design 468.

Stimulation design defines various stimulation parameters (e.g., perforation placement) for performing stimulation operations. The stimulation design 468 may be used, for example, for fracture modeling. Examples of fracture modeling are described in US Patent Application No, 2008/0183451, 2006/0015310 and PCT Publication No. WO2011/077227. Stimulation design may involve using various models to define a stimulation plan and/or a stimulation portion of is well plan.

Stimulation design may integrate 3D reservoir models (formation models), which can be a result of seismic interpretation, drilling geo-steering interpretation, geological or geomechanical earth model, as a starting point (zone model) for completion design. For some stimulation designs, a fracture modeling algorithm may be used to read a 3D MEM and run forward modeling to predict fracture growth. This process may be used so that spatial heterogeneity of a complex reservoir may be taken into account in stimulation operations. Additionally, some methods may incorporate spatial X-Y-Z sets of data to derive an indicator, and then use the indicator to place and/or perform a wellbore operation, and in some instance, multiple stages of wellbore operations as will be described further herein.

Stimulation design may use 3D reservoir models for providing information about natural fractures in the model. The natural fracture information may be used, for example, to address certain situations, such as cases where a hydraulically induced fracture grows and encounters a natural fracture (see. FIGS. 3.2-3.4), in such cases, the fracture can continue growing into the same direction and divert along the natural fracture plane or stop, depending on the incident angle and other reservoir geomechanical properties. This data may provide insights into, for example, the reservoir dimensions and structures, pay zone location and boundaries, maximum and minimum stress levels at various locations of the formation, and the existence and distribution of natural fractures in the formation. As a result of this simulation, nonplanar (i.e. networked) fractures or discrete network fractures may be formed. Some workflows may integrate these predicted fracture models in a single 3D canvas where microseismic events are overlaid (see, e.g., FIG. 3.4). This information may be used in fracture design and/or calibrations.

Microseismic mapping may also be used in stimulation design to understand complex fracture growth. The occurrence of complex fracture growth may be present in unconventional reservoirs, such as shale reservoirs. The nature and degree of fracture complexity may be analyzed to select an optimal stimulation design and completion strategy. Fracture modeling may be used to predict the fracture geometry that can be calibrated and the design optimized based an real time. Microseismic mapping and evaluation. Fracture growth may be interpreted based on existing hydraulic fracture models. Some complex hydraulic fracture propagation modeling and/or interpretation may also be performed for unconventional reservoirs (e.g., tight gas sand and shale) as will be described further herein. Reservoir properties, and initial modeling assumptions may be corrected and fracture design optimized based on microseismic evaluation.

Examples of complex fracture modeling are provided in SPE paper 140185, the entire contents of which is hereby incorporated by reference. This complex fracture modeling illustrates the application of two complex fracture modeling techniques in conjunction with microseismic mapping to characterize fracture complexity and evaluate completion performance. The first complex fracture modeling technique is an analytical model for estimating fracture complexity and distances between orthogonal fractures. The second technique uses a gridded numerical model that allows complex geologic descriptions and evaluation of complex fracture propagation. These examples illustrate how embodiments may be utilized to evaluate bow fracture complexity is impacted by changes in fracture treatment design in each geologic environment. To quantify the impact of changes in fracture design using complex fracture models despite inherent uncertainties in the MEM and "real" fracture growth, microseismic mapping and complex fracture modeling may be integrated for interpretation of the microseismic measurements while also calibrating the complex stimulation model. Such examples show that the degree of fracture complexity can vary depending on geologic conditions.

Production prediction 470 may involve estimating production based on the well planning 465, staging design 466 and stimulation design 468. The result of stimulation design 468 (i.e. simulated fracture models and input reservoir model) can be carried over to a production prediction workflow, where a conventional analytical or numerical reservoir simulator may operate on the models and predicts hydrocarbon production based on dynamic data. The preproduction prediction 470 can be useful, for example, for quantitatively validating the stimulation planning 447 process.

Part or all of the stimulation planning 447 may be iteratively performed as indicated by the flow arrows. As shown, optimizations may be provided after the staging design 466, stimulation design 468, and production prediction 470, and may be used as a feedback to optimize 472 the well planning 465, the staging design 466 and/or the stimulation design 468. The optimizations may be selectively performed to feedback results from part or all of the stimulation planning 447 and iterate as desired into the various portions of the stimulation planning process and achieve an optimized result. The stimulation planning 447 may be manually carried out, or integrated using automated optimization processing as schematically shown by the optimization 472 in feedback loop 473.

FIG. 4.2 schematically depicts a portion of the stimulation planning operation 447. As shown in this figure, the staging design 446, stimulation design 468 and production prediction 470 may be iterated in the feedback loop 473 and optimized 472 to generate an optimized result 480, such as an optimized stimulation plan. This iterative method allows the inputs and results generated by the staging design 466 and stimulation design 468 to 'learn from each other' and iterate with the production prediction for optimization therebetween.

Various portions of the stimulation operation may be designed and/or optimized. Examples of optimizing fracturing are described, for example, in U.S. Pat. No. 6,508,307. In another example, financial inputs, such as fracture costs which may affect operations, may also be provided in the stimulation planning 447. Optimization may be performed by optimizing stage design with respect to production while taking into consideration financial inputs. Such financial inputs may involve costs for various stimulation operations at various stages in the wellbore as depicted in FIG. 4.3.

FIG. 4.3 depicts a staging operation at various intervals and related net present values associated therewith. As shown in FIG. 4.3, various staging designs 455.1 and 455.2 may be considered in view of a net present value plot 457. The net present value plot 457 is a graph plotting mean post-tax net present value (y-axis) versus standard deviation of net present value (x-axis). The various staging designs may be selected based on the financial analysis of the net present value plot 457. Techniques for optimizing fracture design involving financial information, such as net present value are described, for example, in U.S. Pat. No. 7,908,230, the entire contents of which are hereby incorporated by reference. Various techniques, such as, Monte Carlo simulations may be performed in the analysis.

Referring back to FIG. 4.1, various optional features may be included in the stimulation planning 447. For example, a multi-well planning advisor may be used to determine if it is necessary to construct multiple wells in a formation. If multiple wells are to be formed, the multi-well planning advisor may provide the spacing and orientation of the multiple wells, as well as the best locations within each for perforating and treating the formation. As used herein, the term "multiple wells" may refer to multiple wells each being independently drilled front the surface of the earth to the subterranean formation; the term "multiple wells" may also refer to multiple branches kicked off front to single well that is drilled from the surface of the earth (see, e.g., FIG. 3.1). The orientation of the wells and branches can be vertical, horizontal, or anywhere in between.

When multiple wells are planned or drilled, simulations can be repeated for each well so that each well has a staging plan, perforation plan, and/or stimulation plan. Thereafter, multi-well planning can be adjusted if necessary. For example, if a fracture stimulation in one well indicates that a stimulation result will overlap a nearby well with a planned perforation zone, the nearby well and/or the planned perforation zone in the nearby well can be eliminated or redesigned. On the contrary, if a simulated fracture treatment cannot penetrate a particular area of the formation, either because the pay zone is simply too far away for a first fracture well to effectively stimulate the pay zone or because the existence of a natural fracture or high-stress barrier prevents the first fracture well from effectively stimulating the pay zone, a second well/branch or a new perforation zone may be included to provide access to the untreated area. The 3D reservoir model may take into account simulation models and indicate a candidate location to drill a second well/branch or to add an additional perforation zone. A spatial X'-Y'-Z' location may be provided for the oilfield operator's ease of handling.

Post Planning Stimulation Operations

Embodiments may also include real tune treatment optimization (or post job workflows) 451 for analyzing the stimulation operation and updating the stimulation plan during actual stimulation operations. The real time treatment optimization 451 may be performed during implementation of the stimulation plan at the wellsite (e.g., performing fracturing, injecting or otherwise stimulating the reservoir at the wellsite). The real time treatment optimization may involve calibration tests 449, executing 448 the stimulation plan generated in stimulation planning 447, and real time oilfield stimulation 455.

Calibration tests 449 may optionally be performed by comparing the result of stimulation planning 447 (i.e. simulated fracture models) with the observed data. Some embodiments may integrate calibration into the stimulation planning process, perform calibrations after stimulation planning, and/or apply calibrations in real-time execution of stimulation or any other treatment processes. Examples of calibrations for fracture or other stimulation operations are described in US Patent Application No. 2011/0257944, the entire contents of which are hereby incorporated by reference.

Based on the stimulation plan generated in the stimulation planning 447 (and calibration 449 if performed), the oilfield stimulation 445 may be executed 448. Oilfield stimulation 455 may involve real time measurement 461, real time interpretation 463, real time stimulation design 465, real time production 467 and real time control 469. Real time measurement 461 may be performed at the wellsite using, for example, the sensors S as shown in FIG. 3.1. Observed data may be generated using real time measurements 461. Observation from a stimulation treatment well, such as bottom hole and surface pressures, may be used for calibrating models (traditional pressure match workflow). In addition, microseismic monitoring technology may be included as well. Such spatial/time observation data may be compared with the predicted fracture model.

Real time interpretation 463 may be performed on or off site based on the data collected. Real time stimulation design 465 and production prediction 467 may be performed similar to the stimulation design 468 and production prediction 470, but based on additional information generated during the actual oilfield stimulation 455 performed at the wellsite. Optimization 471 may be provided to iterate over the real time stimulation design 465 and production prediction 467 as the oilfield stimulation progresses. Real time stimulation 455 may involve, for example, real time fracturing. Examples of real time fracturing are described in US Patent Application No 2010/0307755, the entire contents of which are hereby incorporated by reference.

Real time control 469 may be provided to adjust the stimulation operation at the wellsite as information is gathered and an understanding of the operating conditions is gained. The real time control 469 provides a feedback loop for executing 448 the oilfield stimulation 455. Real time control 469 may be executed, for example, using the surface unit 334 and/or downhole tools 306.1-306.4 to alter operating conditions, such as perforation locations, injection pressures, etc. While the features of the oilfield stimulation 455 are described as operating in real time, one or more of the features of the real time treatment optimization 451 may be performed in real time or as desired.

The information generated during the real time treatment optimization 451 may be used to update the process and feedback to the reservoir characterization 445. The design model update 453 includes post treatment evaluation 475 and update model 477. The post treatment evaluation involves analyzing the results of the real time treatment optimization 451 and adjusting, as necessary, inputs and plans for use in other wellsites or wellbore applications.

The post treatment evaluation 475 may be used as an input to update the model 477. Optionally, data collected from subsequent drilling and/or production can be fed back to the reservoir characterization 445 (e.g., the 3D earth model and/or stimulation planning 447 (e.g., well planning, module 465). Information may be updated to remove errors in the initial modeling and simulation, to correct deficiencies in the initial modeling, and/or to substantiate the simulation. For example, spacing or orientation of the wells may be adjusted to account the newly developed data. Once the model is updated 477, the process may be repeated as desired. One or more wellsites, wellbores, stimulation operations or variations may be performed using the method 400.

In a given example, a stimulation operation may be performed by constructing a 3D model of a subterranean formation and performing a semi-automated method involving dividing the subterranean formation into a plurality of discrete intervals, characterizing each interval based on the subterranean formation's properties at the interval, grouping the intervals into one or more drilling sites, and drilling a well in each drilling site.

Tight Gas Sand Applications

An example stimulation design and downstream workflow useful for unconventional reservoirs involving tight gas sandstone (see, e.g., reservoirs 304.1-304.3 of FIG. 3.1) are provided. For tight gas sandstone reservoir workflow, is conventional stimulation (i.e. hydraulic fracturing) design method may be used, such as a single or multi-layer planar fracture model.

FIGS. 5.1 and 5.2 depict examples of staging involving a tight gas sand reservoir. A multi-stage completion advisor may be provided for reservoir planning for tight gas sandstone reservoirs where a plurality of thin layers of hydrocarbon rich zones (e.g., reservoirs 304.1-304.3 of FIG. 3.1) may be scattered or dispersed over a large portion of the formation adjacent the wellbore (e.g., 336.1). A model may be used to develop a near wellbore zone model, where key characteristics, such as reservoir (pay) zone and geomechanical (stress) zone, may be captured.

FIG. 5.1 shows a log 500 of a portion of a wellbore the wellbore 336.1 of FIG. 3.1). The log may be a graph of measurements, such as resistivity, permeability, porosity, or other reservoir parameters logged along the wellbore. In some cases, as shown in FIG. 6, multiple logs 600.1, 600.2 and 600.3 may be combined into a combined log 601 for use in the method 501. The combined log 601 may be based on a weighted linear combination of multiple logs, and corresponding input cutoffs may be weighted accordingly.

The log 500 (or 601) may correlate to a method 501 involving analyzing the log 500 to define (569) boundaries 508 at intervals along the log 500 based on the data provided. The boundaries 568 may be used to identify (571) pay zones 570 along the wellbore. A fracture unit 572 may be specified (573) along the wellbore. Staging design may be performed (575) to define stages 574 along the wellbore. Finally, perforations 576 may be designed (577) along locations in the stages 574.

A semi-automated method may be used to identify partitioning of a treatment interval into multiple sets of discrete intervals (multi-stages) and to compute a configuration of perforation placements, based on these inputs. Reservoir (petrophysical) information and completion (geomechanical) information may be factored into the model, simultaneously. Zone boundaries ma be determined based on input logs. Stress logs may be used to define the zones. One can choose any other input log or a combination of logs which represents the reservoir formation.

Reservoir pay zones can be imported from an external (e.g., petrophysical interpretation) workflow. The workflow may provide a pay zone identification method based on multiple log cutoffs. In the latter case, each input log value (i.e. default logs) may include water saturation (Sw), porosity (Phi), intrinsic permeability (Kint) and volume of clay (Vcl), but other suitable logs can be used. Log values may be discriminated by their cutoff values. If all cutoff conditions are met, corresponding depth may be marked as a pay zone. Minimum thickness of a pay zone, KH (permeability multiplied by zone height) and PPGR (pore pressure gradient) cutoff conditions may be applied to eliminate poor pay zones at the end. These pay zones may be inserted into the stress based zone model. The minimum thickness condition may be examined to avoid creation of tiny zones. The pay zones may also be selected and the stress based boundary merged therein. In another embodiment, 3D zone models provided by the reservoir modeling process may be used as the base boundaries and the output zones, finer zones, may be inserted.

For each identified pay zones, a simple fracture height growth estimation computation based on a net pressure or a bottom hole treating pressure may be performed, and the over lapping pays combined to form a fracture unit (FracUnit). Stimulation stages may be defined based on one or more of the following conditions: minimum net height, maximum gross height and minimum distance between stages.

The set of FracUnits may be scanned, and possible combinations of consecutive FracUnits examined. Certain combinations that violate certain conditions may be selectively excluded. Valid combinations identified may act as staging scenarios. A maximum gross height (=stage length) may be variated and combinatory checks run repeatedly for each of the variations. Frequently occurring staging scenarios may be counted from a collection of all outputs to determine final answers. In some cases, no 'output' may be found because no single staging design may be ascertained that meets all conditions. In such case, the user can specify the priorities among input conditions. For example, maximum gross height may be met, and minimum distance between stage may be ignored to find the optimum solution.

Perforation locations, shot density and number of shots, may be defined based on a quality of pay zone if the stress variations within a stage are insignificant. If the stress variations are high, a limited entry method may be conducted to determine distribution of shots among fracture units. A user can optionally choose to use a limited entry method (e.g., stage desired. Within each FracUnit, a location of perforation may be determined by a selected KH (permeability multiplied by perforation length).

A multi-stage completion advisor may be used for reservoir planning for a gas shale reservoir. Where a majority of producing wells are essentially horizontally drilled (or drilled deviated from a vertical borehole) an entire lateral section of a borehole may reside within a target reservoir formation (see, e.g., reservoir 304.4 of FIG. 1). In such cases, variability of reservoir properties and completion properties may be evaluated separately. The treatment interval may be partitioned into a set of contiguous intervals (multi-stages). The partitioning may be done such that both reservoir and completion properties are similar within each stage to ensure the result (completion design) offers maximum coverage of reservoir contacts.

In a given example, stimulation operations may be performed utilizing a partially automated method to identify best multistage perforation design in a wellbore. A near wellbore zone model may be developed based upon key characteristics, such as reservoir pay zone and geomechanical stress zone. A treatment interval may be partitioned into multiple set of discrete intervals, and a configuration of perforation placement in the wellbore may be computed. A stimulation design workflow including single or multi-layer planar fracture models may be utilized.

Shale Applications

FIGS. 7-12 depict staging for an unconventional application involving a gas shale reservoir (e.g., reservoir 304.4 in FIG. 3.1). FIG. 13 depicts a corresponding method 1300 for staging stimulation of a shale reservoir. For gas shale reservoirs, a description of naturally fractured reservoirs may be utilized. Natural fractures may be modeled as a set of planar geometric objects, known as discrete fracture networks (see, e.g., FIGS. 3.2-3.4). Input natural fracture data may be combined with the 3D reservoir model to account for heterogeneity of shale reservoirs and network fracture models (as opposed to planar fracture model). This information may be applied to predict hydraulic fracture progressions.

A completion advisor for a horizontal well penetrating formations of shale reservoirs is illustrated in FIGS. 7 through 12. The completions advisor may generate a multi-stage stimulation design, comprising a contiguous set of staging intervals and a consecutive set of stages. Additional inputs, such as fault zones of any other interval information may also be included in the stimulation design to avoid placing stages.

Figure 7:
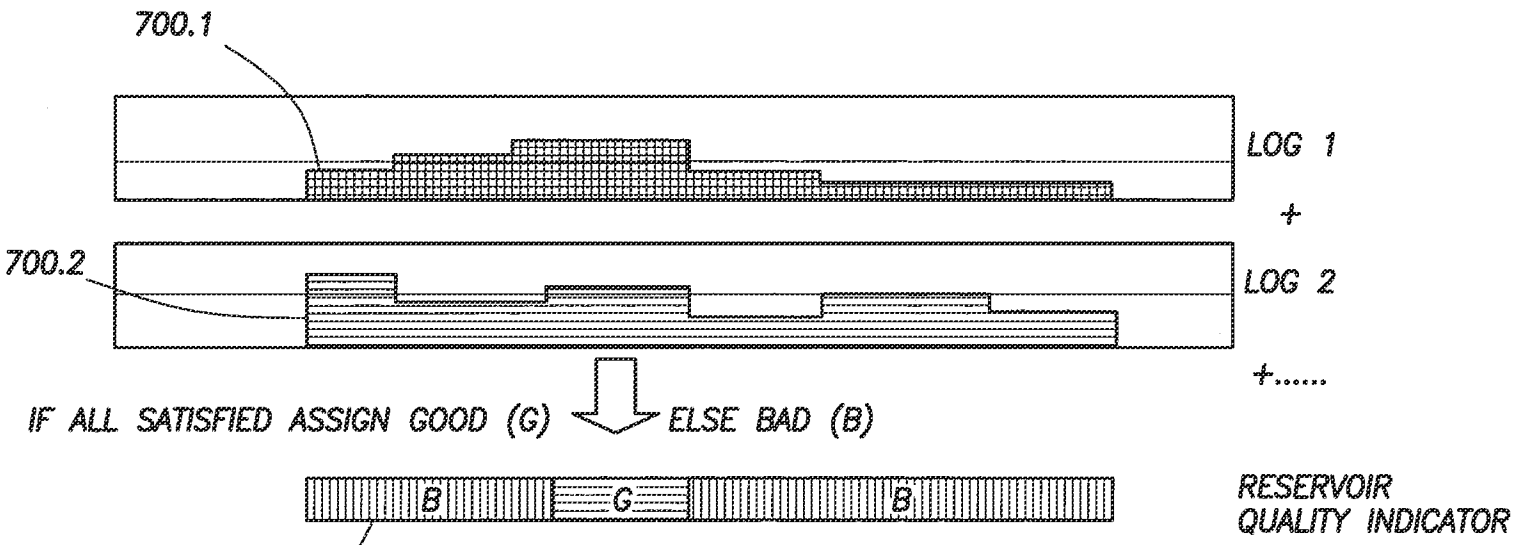
FIG. 7 is a schematic diagram depicting a reservoir quality indicator formed from a first and a second log.

FIGS. 7-9 depict the creation of a composite quality indicator for a shale reservoir. The reservoir quality and completion quality along the lateral segment of borehole may be evaluated. A reservoir quality indicator may include, for example, various requirements or specifications, such as total organic carbon (TOC) greater than or equal to about 3%, gas in place (GIP) greater than about 100 scf/ft$^3$, Kerogen greater than high, shale porosity greater than about 4%, and relative permeability to as (Kgas) greater than about 100 nD. A completions quality indicator may include, for example, various requirements or specifications, such as stress that is '-low', resistivity that is greater than about 15 Ohm-m, clay that is less than 40%, Young's modulus (YM) is greater than about $2\times10^6$ psi ( ), Poisson's ratio (PR) is less than about 0.2, neutron porosity is less than about 35% and density porosity is greater than about 8%.

FIG. 7 schematically depicts a combination of logs 700.1 and 700.2. The logs 700.1 and 700.2 may be combined to generate a reservoir quality indicator 701. The logs may be reservoir logs, such as permeability, resistivity, porosity logs from the wellbore. The logs have been adjusted to a square format for evaluation. The quality indicator may be separated (1344) into regions based on a comparison of logs 700.1 and 700.2, and classified under a binary log as Good (G) and Bad (B) intervals. For a borehole in consideration, any interval where all reservoir quality conditions are met may be marked as Good, and everywhere else set as Bad.

Other quality indicators, such as a completions quality indicator, may be formed in a similar manner using applicable logs (e.g., Young's modulus, Poisson's ratio, etc. for a completions log). Quality indicators, such as reservoir quality 802 and completion quality 801 may be combined (1346) to form a composite quality indicator 803 as shown in FIG. 8.

Figure 10:
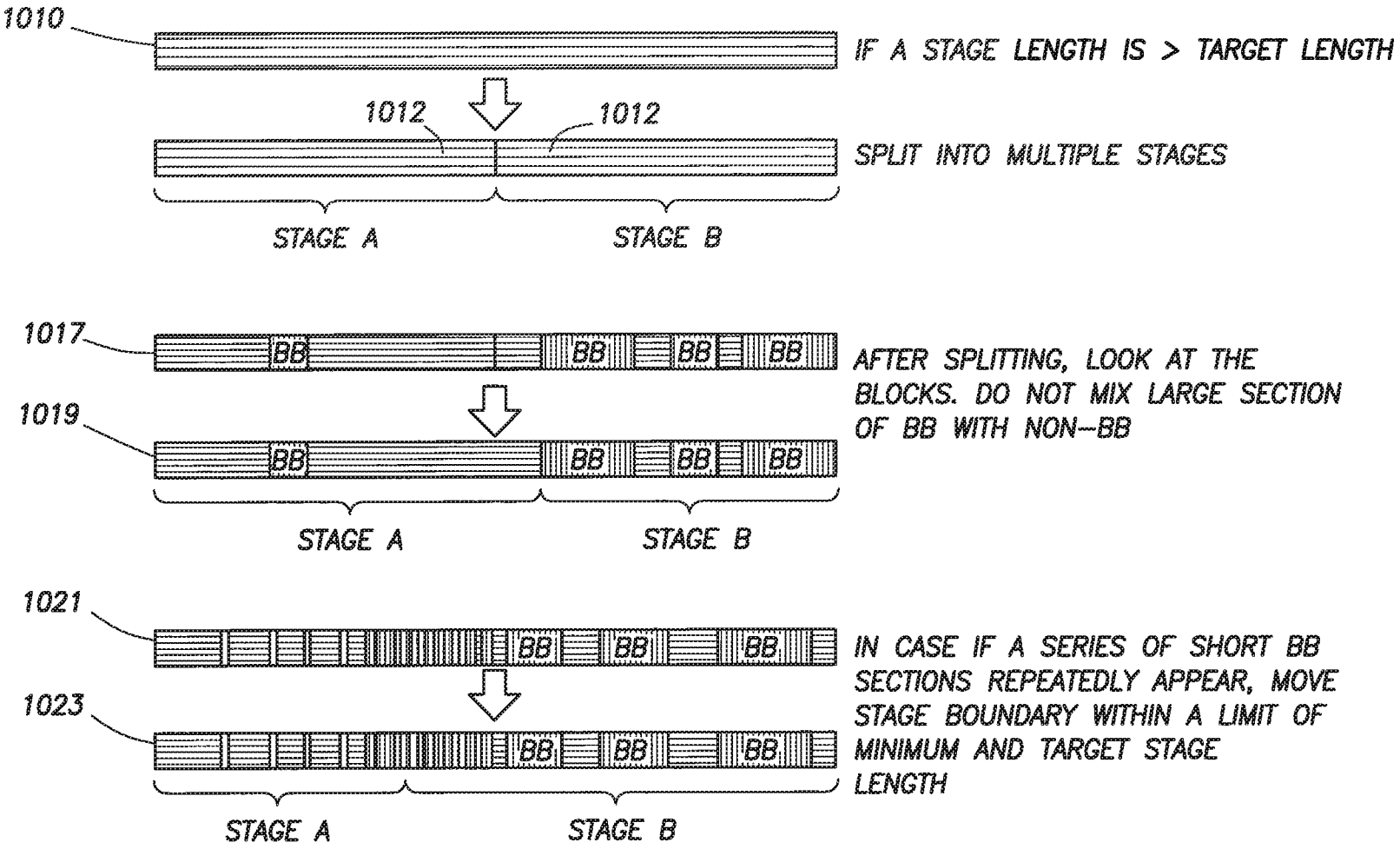
FIG. 10 is a schematic diagram depicting stage boundary adjustment to enhance the homogeneity of composite quality indicators.
Figure 11:
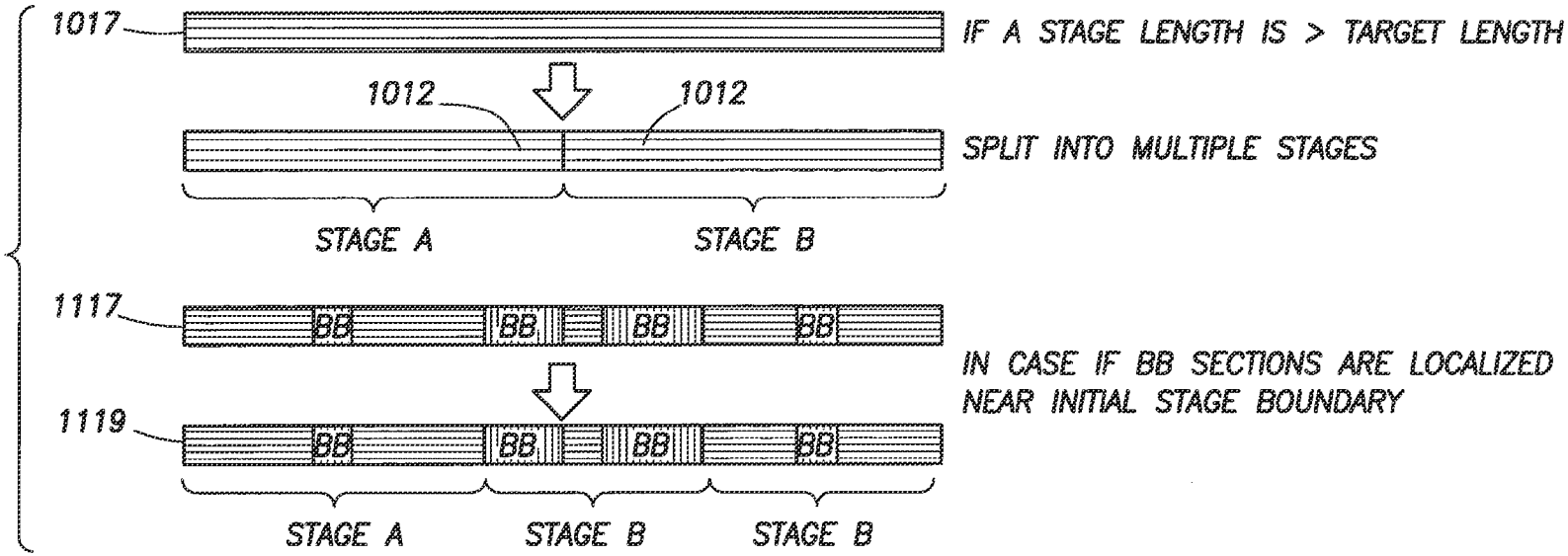
FIG. 11 is a schematic diagram depicting stage splitting based on a composite quality indicator.

FIGS. 9-11 depict stage definition for the shale reservoir. A composite Quality indicator 901 (which may be the composite quality indicator 803 of FIG. 8) is combined (1348) with as stress log 903 segmented into stress blocks by a stress gradient differences. The result is a combined stress & composite quality indicator 904 separated into GB, GG, BB and BG classifications at intervals. Stages may be defined along the quality indicator 904 by using the stress gradient log 903 to determine boundaries. A preliminary set of stage boundaries 907 are determined at the locations where the stress gradient difference is greater than a certain value (e.g., a default may be 0.15 psi/ft). This process may generate a set of homogeneous stress blocks along the combined stress and quality indicator.

Stress blocks may be adjusted to a desired size of blocks. For example, small stress blocks may be eliminated where an interval is less than a minimum stage length by merging it with an adjacent block to form a refined composite quality indicator 902. One of two neighboring blocks which has a smaller stress gradient difference may be used as a merging target. In another example, large stress blocks may be split where an interval is more than a maximum stage length to form another refined composite quality indicator 905.

As shown in FIG. 10, to large block 1010 may be split (1354) into multiple blocks 1012 to form stages A and B where an interval is greater than a maximum stage length. After the split, a refined composite quality indicator 1017 may be formed, and then split into a non-BB composite quality indicator 1019 with stages A and B. In some cases as shown in FIG. 10, grouping large 'BB blocks with non-BB' blocks, such as 'GG' blocks, within a same stage, may be avoided.

If a 'BB' block is large enough as in the quality indicator 1021, then the quality indicator may be shifted (1356) into its own stage as shown in the shifted quality indicator 1023. Additional constraints, such as hole deviation, natural and/or induced fracture presence, may be checked to make stage characteristics homogeneous.

As shown in FIG. 11, the process in FIG. 10 may be applied for generating a quality indicator 1017 and splitting into blocks 1012 shown as stages and B. BB blocks may be identified in a quality indicator 1117, and split into a shifted quality indicator 1119 having three stages A, B and C. As shown by FIGS. 10 and 11, various numbers of stages may be generated as desired.

Figure 12:
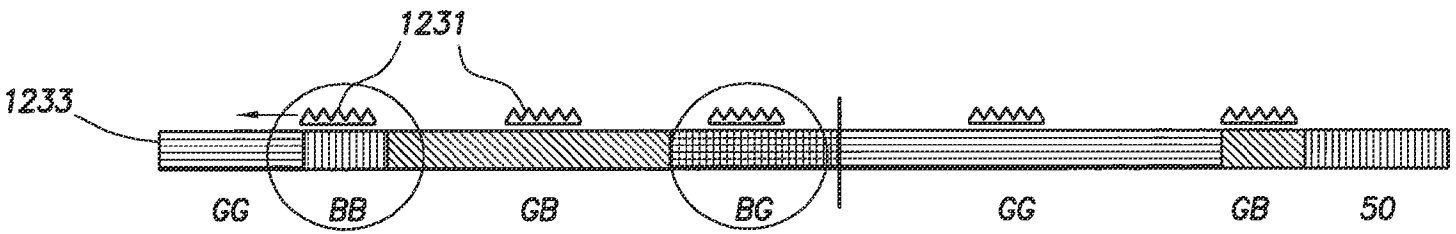
FIG. 12 is a diagram depicting perforation placement based on a quality indicator.
Figure 13:
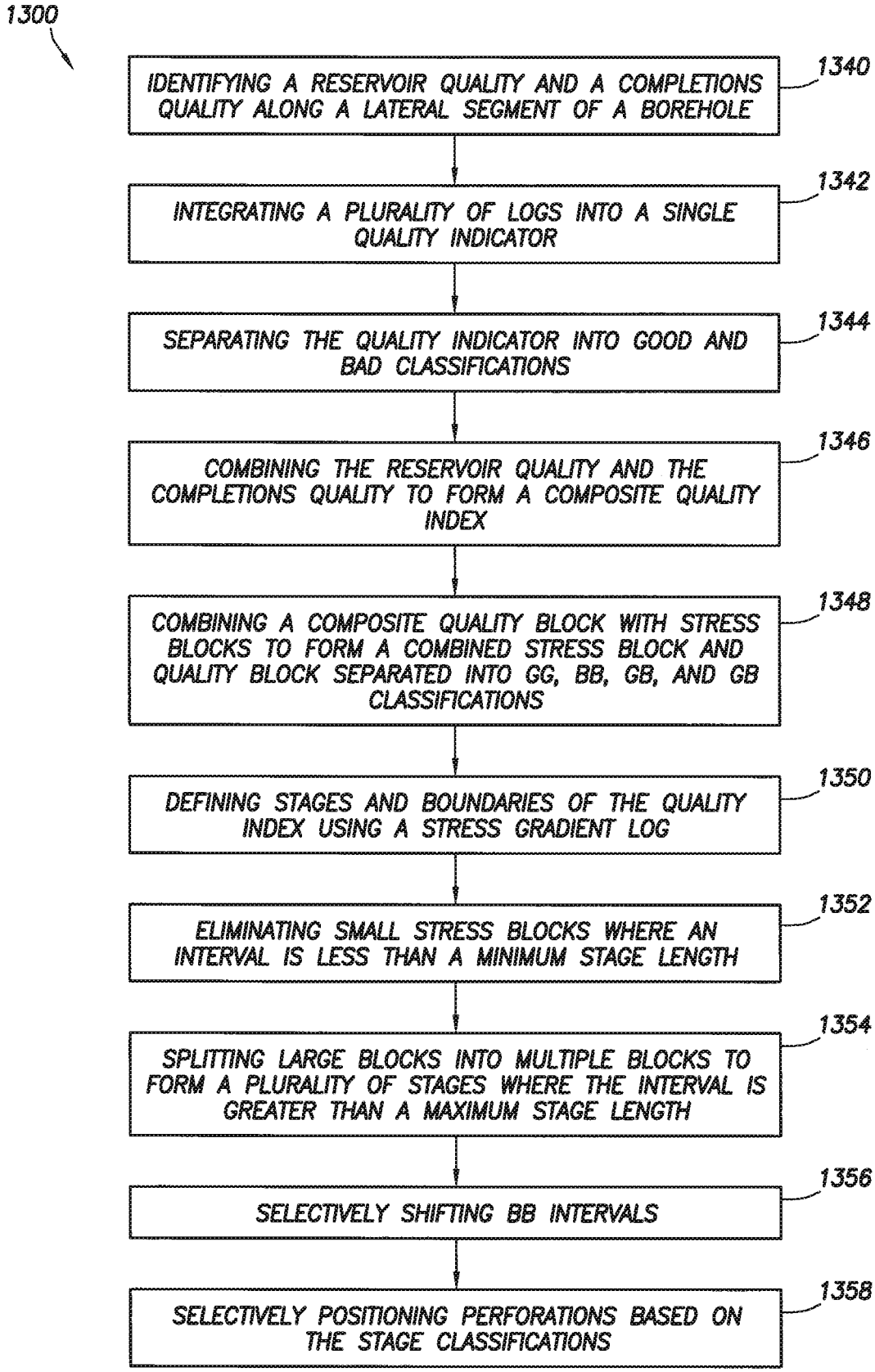
FIG. 13 is a flow diagram illustrating a method of staging a stimulation operation for a shale reservoir.

As shown in FIG. 12, perforation clusters (or perforations) 1231 may be positioned (1358) based on stage classification results and the composite quality indicator 1233. In shale completion design, the perforations may be placed evenly (in equal distance, e.g., every 75 ft (22.86 m)). Perforations close to the stage boundary (for example 50 ft (15.24 m)) may be avoided. The composite quality indicator may be examined at each perforation location. Perforation in 'BB' blocks may be moved adjacent to the closest 'GG', 'GB' or 'BG' block as indicated by a horizontal arrow. If a perforation falls in a 'BG' block, further fine grain GG, GB, BG, BB reclassification may be done and the perforation placed in an interval that does not contain a BB.

Stress balancing may be performed to locate where the stress gradient values are similar (e.g. within 0.05 psi/ft) within a stage. For example, if the user input is 3 perforations per stage, a best (i.e. lowest stress gradient) location which meets conditions (e.g., where spacing between perforations and are within the range of stress gradient) may be searched. If not located, the search may continue for the next best location and repeated until it finds, for example, three locations to put three perforations.

If a formation is not uniform or is intersected by major natural fractures and/or high-stress barriers, additional well planning may be needed. In one embodiment, the underground formation may be divided into multiple sets of discrete volumes and each volume may be characterized based on information such as the formation's geophysical properties and its proximity to natural fractures. For each factor, an indicator such as "G" (Good), "B" (Bad), or "N" (Neutral) can be assigned to the volume. Multiple factors can then be synthesized together to form a composite indicator, such as "GG", "GB", "GN", and so on. A volume with multiple "B"s indicates a location may be less likely to be penetrated by fracture stimulations. A volume with one or more "G"s may indicate a location that is more likely to be treatable by fracture stimulations. Multiple volumes can be grouped into one or more drilling wet kites, with each wellsite representing a potential location for receiving it well or a branch. The spacing and orientation of multiple wells can be optimized to provide an entire formation with sufficient stimulation. The process may be repeated as desired.

While FIGS. 5.1-6 and FIGS. 7-12 each depict specific techniques for staging, various portions of the staging may optionally be combined. Depending on the wellsite, variations in staging design may be applied.

FIG. 13 is a flow diagram illustrating a method (1300) of performing a diversion-assisted stimulation operation. The method involves identifying (1340) a reservoir quality indicator and a completion quality indicator along a lateral segment of a borehole, integrating (1342) a plurality of logs into a single quality indicator, separating (1344) the quality indicator into good and had classifications; combining (1346) the reservoir quality indicator and the completions quality indicator to form a composite quality index; combining (1.348) a composite quality index with stress blocks to form a combined stress block and quality block separated into GG, GB, BG and BB classifications; defining (1350) stages and boundaries of the quality index using a stress gradient log; eliminating (1352) small stress stages where an interval is less than a minimum stage length; splitting (1354) large stages to form a plurality of stages where the interval is greater than a maximum stage length, selectively shifting (1356) BB intervals and selectively positioning (1358) perforations based on the diverter assisted stage classifications.

Figure 14:
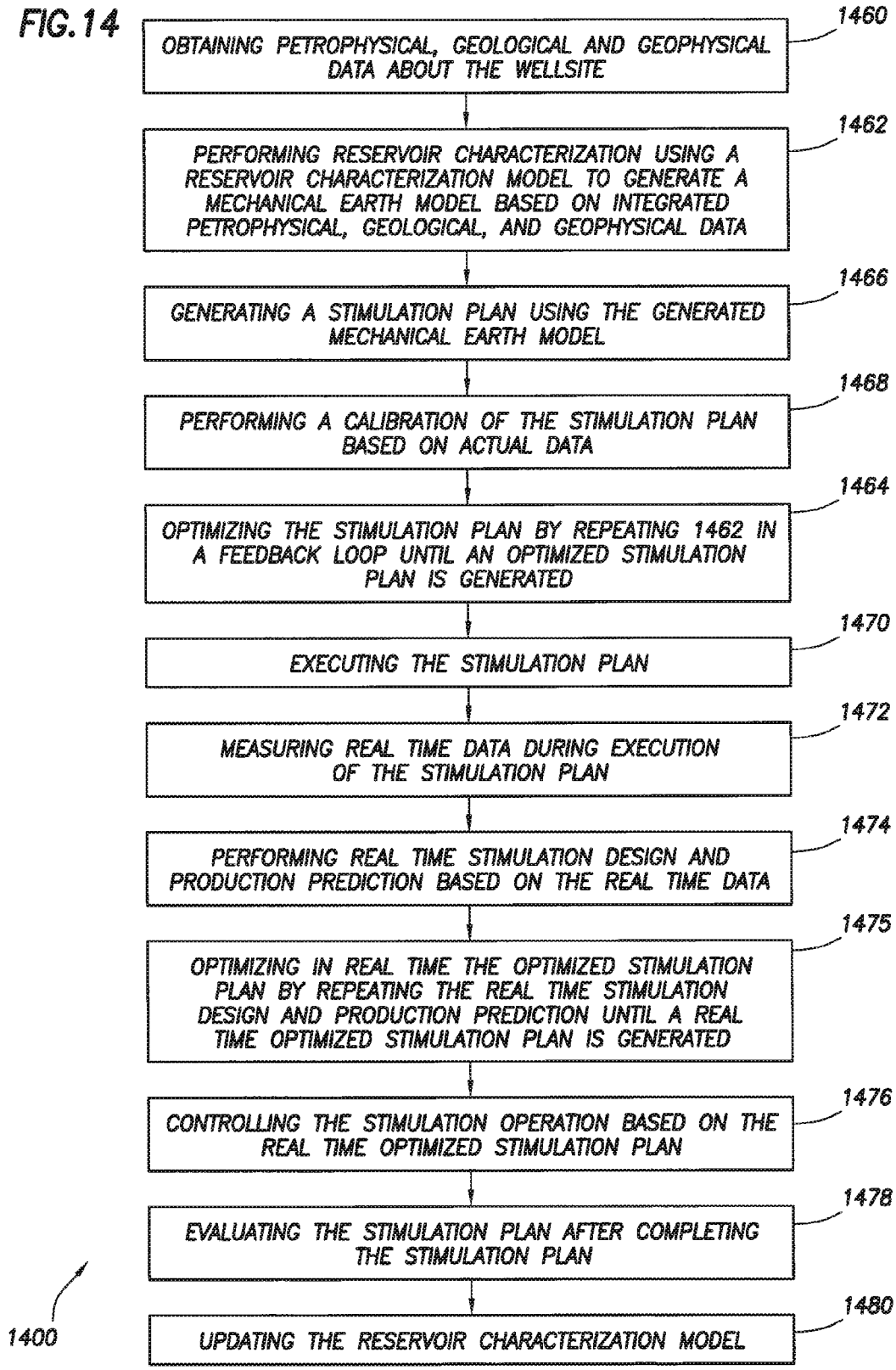
FIG. 14 is a flow diagram illustrating a method of performing a downhole stimulation operation.

FIG. 14 is a flow diagram illustrating a method (1400) of performing a stimulation operation. The method involves obtaining (1460) petrophysical, geological and geophysical data about the wellsite, performing (1462) reservoir characterization using a reservoir characterization model to generate a mechanical earth model based on integrated petrophysical, geological and geophysical data (see, e.g., pre-stimulation planning 445). The method further involves generating (1466) a stimulation plan based on the generated mechanical earth model. The generating (1466) may involve, for example, well planning 465, staging design, 466, stimulation design 468, production prediction 470 and optimization 472 in the stimulation planning 447 of FIG. 4. The stimulation plan is then optimized (1464) by repeating (1462) in a continuous feedback loop until an optimized stimulation plan is generated.

The method may also involve performing (1468) a calibration of the optimized stimulation plan (e.g., 449 of FIG. 4). The method may also involve executing (1470) the stimulation plan, measuring (1472) real time data during execution of the stimulation plan, performing real time stimulation design and production prediction (1474) based on the teal time data, optimizing in real time (1475) the optimized stimulation plan by repeating the real time stimulation design and production prediction until a real time optimized stimulation plan is generated, and controlling (1476) the stimulation operation based on the real time optimized stimulation plan. The method may also in evaluating (1478) the stimulation plan after completing the stimulation plan and updating (1480) the reservoir characterization model (see, e.g., design/model updating 453 of FIG. 4). The steps may be performed in various orders and repeated as desired.

Diversion Operations

One specific type of well operation is a diversion treatment. Hydraulic and acid fracturing of horizontal wells as well as multi-layered formations may require using diverting techniques in order to enable fracturing redirection between different zones. Examples of suitable diverting techniques may include the application of hall sealers, slurried benzoic acid flakes and/or removable/degradable particulates, as described in U.S. Patent Application Pub. No. 2012/0285692, the disclosure of which is incorporated by reference herein in its entirety. As well, other treatments may employ of diverting techniques.

Disclosed herein are diverter-assisted-staging algorithms for a well penetrating a subterranean formation. Separate algorithms may be used for vertical and horizontal wells. The diverter-assisted staging algorithm may include various semi-automated processes to identify the optimum multi-stage perforation and staging design for treatments using a diverter. As used herein, the term "diverter" refers to a material placed within a subterranean formation to partially or entirely plug a feature of the subterranean formation, such as, for example, a perforation or fracture of the formation. The term "diverter" should not be defined to include "bridge plugs" or any similar device, which are employed to isolate a specific section of a wellbore.

The staging algorithms utilize a variety of reservoir data that may be obtained both from the subterranean formation and/or the 3D geological model. The algorithms may also utilize petrophysical properties such as, for example, open hole and cased hole logs, borehole images, core data and 3D reservoir models to determine reservoir quality. Geomechanical properties such as, for example, in-situ rock stresses, modulus of elasticity, leak-off coefficient, Poisson's ratio of the wellbore may be used to determine fracture initiation, propagation, and containment within the target zones (completion quality).

For vertical wells, once the boundaries, reservoir (pay) zones, FracUnits are defined and the staging design is completed, the diverter's ability at overcoming stress variations may be incorporated into a perforation design to promote the distribution of the fracturing fluids, such as limited entry method, which is achieved by choosing perforation diameter and number of perforations such that the anticipated injection rate produces sufficient velocity though each perforation to create a pressure differential between the hydraulic fracture and the wellbore.

An example stimulation design and downstream workflow useful for unconventional reservoirs involving tight gas sandstone (see, e.g., reservoirs 304.1-304.3 of FIG. 3.1) are provided. For tight gas sandstone reservoir workflow, a conventional stimulation (i.e. hydraulic fracturing) design method may be used, such as a single or multi-layer planar fracture model.

A diverter-assisted completion advisor for a vertical well penetrating formations of shale reservoirs is illustrated in FIG. 15.1 and FIG. 15.2. FIGS. 15.1 and 15.2 depict examples of staging involving a tight gas sand reservoir with a diverter. A multi-stage completion advisor may be provided for reservoir planning for tight gas sandstone reservoirs where a plurality of thin layers of hydrocarbon rich zones (e.g., reservoirs 304.1-304.3 of FIG. 3.1) may be scattered or dispersed over a large portion of the formation adjacent the wellbore (e.g., 336.1). A model may be used to develop a near wellbore zone model, where key characteristics, such as reservoir (pay) zone and geomechanical (stress) zone, may be captured.

FIG. 15.1 shows a log 1500 of a portion of a wellbore (e.g., the wellbore 336.1 of FIG. 3.1). The log may be a graph of measurements, such as resistivity, permeability, porosity, or other reservoir parameters logged along the wellbore. In some cases, as shown in FIG. 6, multiple logs 600.1, 600.2 and 600.3 may be combined into a combined log 601 for use in the method 1501 (as illustrated in FIG. 15.2). The combined log 601 may be based on a weighted linear combination of multiple logs, and corresponding input cutoffs may be weighted accordingly.

The log 1500 (or 601) may correlate to a method 1501 involving analyzing the log 1500 to define (1569) boundaries 1568 at intervals along the log 1500 based on the data provided. The boundaries 1568 may be used to identify 1571) pay zones 1570 along the wellbore. A fracture unit 1572 may be specified (1573) along the wellbore. Staging design may be performed (1575) to define stages 1574 along the wellbore. Perforations 1576 may be designed (1577) along locations in the stages 1574. Finally, as diversion treatment may be designed (1579) along one or more of the locations in stages 1574. The diversion design should include a quantity of diverter such as, for example, the quantity or amount of diverter to plug a number of perforations in order to generate an additional pressure differential between the hydraulic fracture(s) and the wellbore required to divert fluid to other perforations. The diverter may be selected based upon information known to persons skilled in the art, with rules such as being able to plug the downhole features the induced fracture.

For horizontal wells, reservoir quality indicators and completion quality indicators are classified and combined in composite quality blocks, as discussed in further detail below. Generally, stress information may be used to generate stress blocks. Here stress may mean the computed fracture initiation or breakdown pressure derived from the in-situ stresses and wellbore properties. If the stress difference between blocks is lower than a threshold value defined by the pressure which is generated by the diverter, then the stress blocks are merged. The merged stress blocks and the composite quality index are combined to design stages and perforation clusters. Finally, the diverter enables adding a final step of selectively positioning, the perforations.

Figure 16:
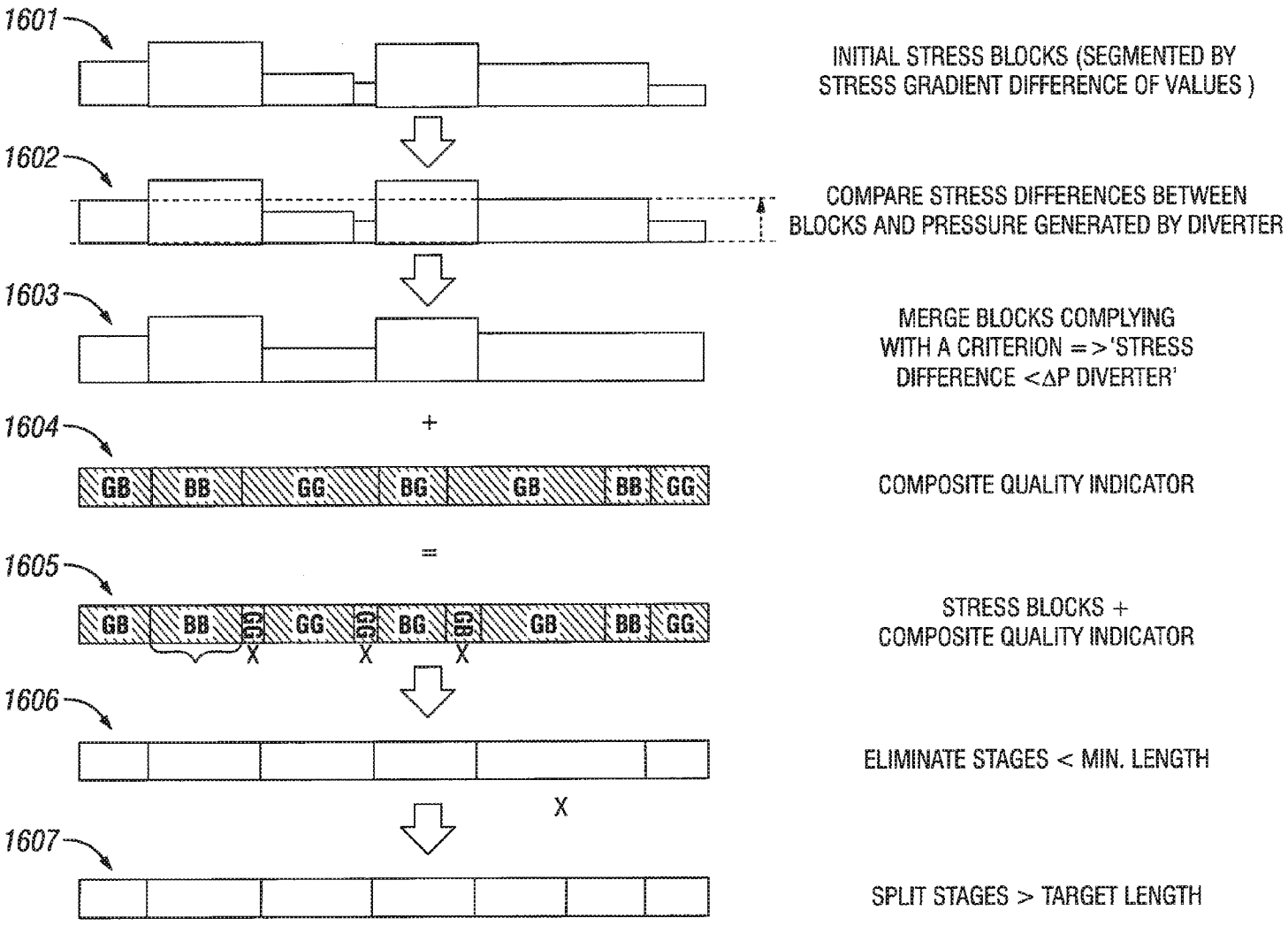
FIGS. 16-19 are diagrams illustrating a method of staging a stimulation operation for a shale reservoir in a vertical well.

A diverter-assisted-completion advisor for a horizontal well penetrating formations of shale reservoirs is illustrated in FIG. 16. The diverter-assisted-completions advisor may generate a multi-stage stimulation design, comprising a contiguous set of staging intervals and a consecutive set of stages. Additional inputs, such as fault zones or any other interval information may also be included in the stimulation design to avoid placing stages.

FIG. 16 depicts a stage definition for the shale reservoir. First, a stress log is being segmented in stress blocks by a stress gradient difference of values (e.g., about 0.15 psi/ft) (1601). The stress differences between the stress blocks and pressure generated by the diverter are then compared (1602). The stress blocks are then "merged" or "combined" (1603) if the stress difference between two (2) blocks is less than the pressure which can be generated with the diverter. A composite quality indicator 1604 (which ma be the composite quality indicator 803 of FIG. 8) is combined with a stress log segmented into merged stress blocks by stress gradient differences lower than the pressure generated by the diverter (1604). The result is a combined stress and composite quality indicator separated into GB, GG, BB and BG classifications at intervals (1605). Stages may be defined along the stress and composite quality indicator 1605 by using the stress gradient log 903 to determine boundaries. A preliminary set of stage boundaries 907 are determined at the locations where the stress gradient difference is greater than the difference which can be overcome by a diverter. This process may generate a set of homogeneous merged-stress blocks along the combined stress and quality indicator.

Stress blocks may be adjusted to a desired site of blocks. For example, small stress blocks may be eliminated where an interval is less than a minimum stage length by merging it with an adjacent block to form a refined composite quality indicator 1606. One of two neighboring blocks which has a smaller stress gradient difference may be used as a merging target. In another example, large stress blocks may be split where an interval is more than a maximum stage length to form another refined composite quality indicator 1607.

Figure 17:
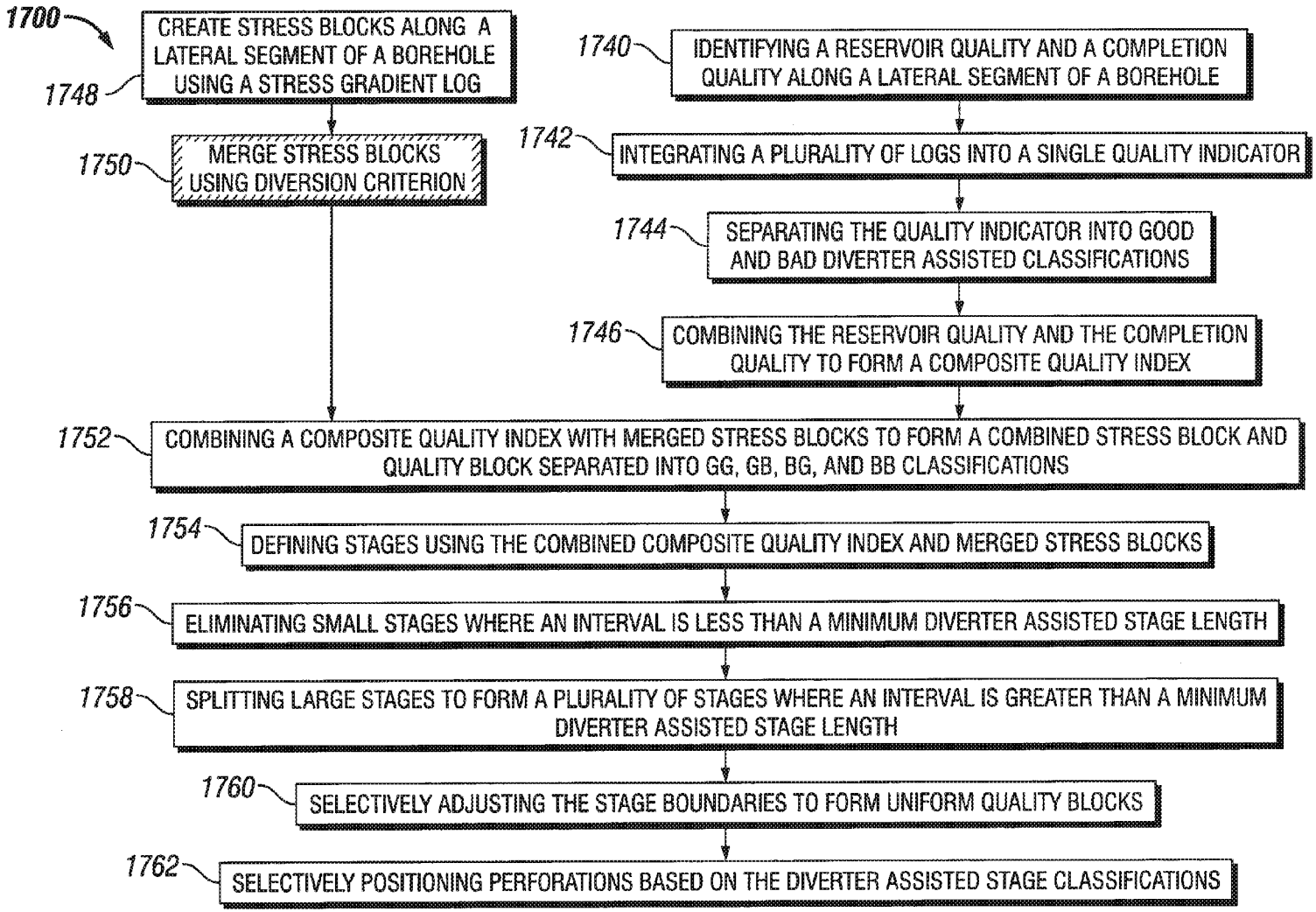

FIG. 17 is a flow diagram illustrating a method (1700) of performing a diversion-assisted stimulation operation. The method involves identifying (1740) a reservoir quality indicator and a completion quality indicator along a lateral segment of a borehole, integrating (1742) a plurality of logs into a single quality indicator, separating (1744) the reservoir quality indicator into good and had classifications and combining (1746) the reservoir quality indicator and the completion quality indicator to form a composite quality index. Independently of the identifying (1740), integrating (1742), separating (1744) and combining (1746) steps, the method further involves creating (1748) stress blocks along a lateral segment of a borehole and merging (1750) the stress blocks using the diversion criterion discussed above in 1603. The method then further involves combining (1752) a composite quality index (1746) with the merged stress blocks (1750) to form a combined stress block, and quality block separated into at least one of the following diverter-assisted classifications: GG, GB, BG and BB, defining (1754) stages using the combined composite quality index and merged stress blocks (1752), eliminating (1756) small stages where an interval is less than a minimum diverter assisted stage length, splitting (1758) large stages to form a plurality of stages where an interval is greater than a minimum diverter assisted stage length, selectively adjusting (1760) the stage boundaries to form uniform quality blocks and selectively positioning (1762) perforations based on the diverter assisted classifications. The minimum stage length is often a balance between time efficiency (e.g., cost of treatment) which decreases as the stage gets longer and the quality of stimulation decreases. In some fields, the stage length may be from about 200 to about 500 ft in horizontal completion.

Figure 18:
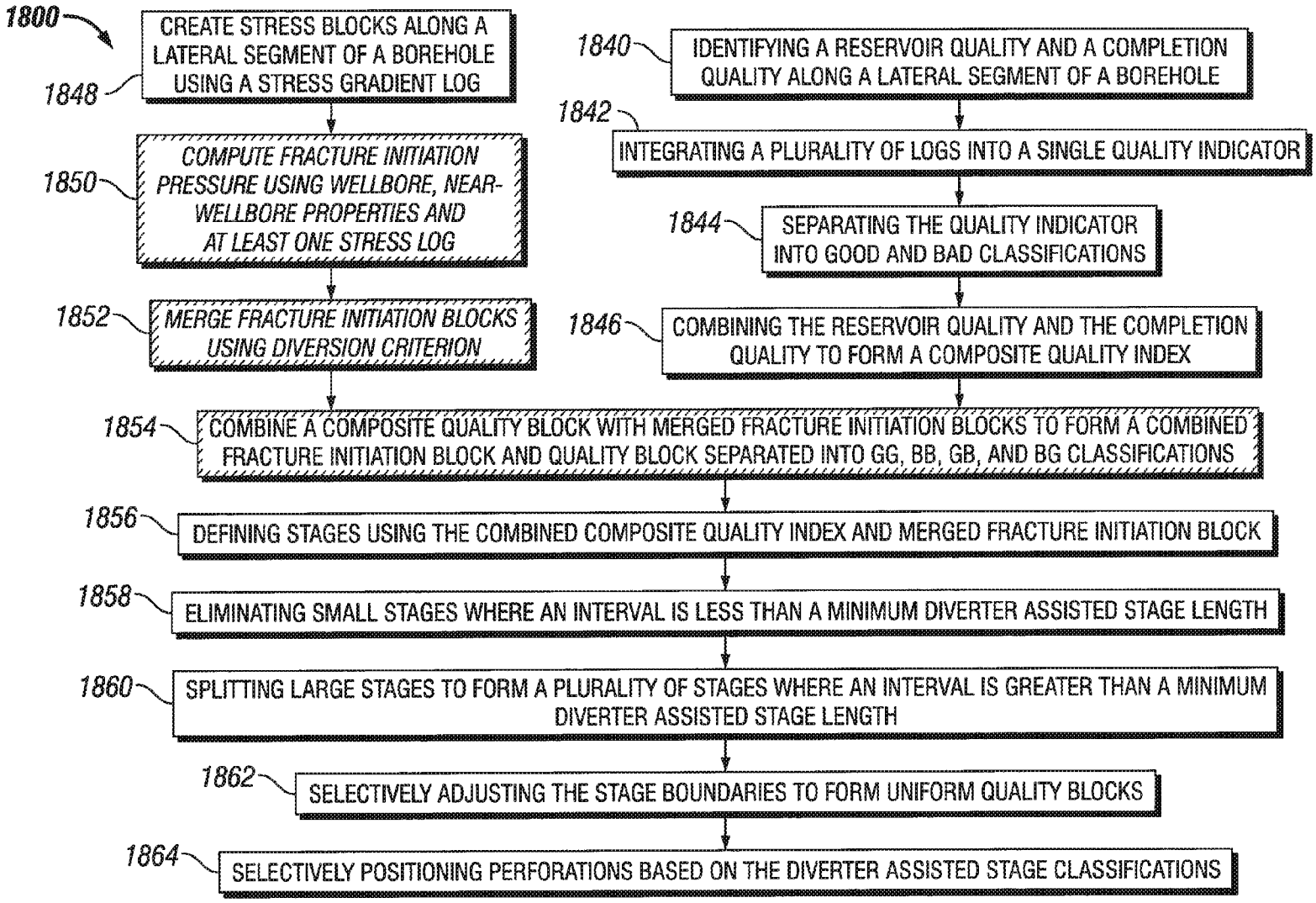

FIG. 18 is a flow diagram illustrating a method (1800) of performing a diversion-assisted stimulation operation. The method involves identifying (1840) a reservoir quality indicator and a completion quality indicator along a lateral segment of a borehole, integrating (1842) a plurality of logs into a single quality indicator, separating (1844) the reservoir quality indicator into good and bad classifications and combining (1846) the reservoir duality indicator and the completion quality indicator to form a composite quality index. Independently of the identifying (1840), integrating (1842), separating (1844) and combining (1846) steps, the method further involves creating (1848) stress blocks along a lateral segment of a borehole, computing (1850) the fracture initiation pressure using one or more of the wellbore properties, near-wellbore properties and stress log, and merging (1852) the fracture initiation blocks using the diversion criterion discussed above in 1603. The method then further involves combining (1854) a composite quality index (1846) with the merged fracture initiation blocks (1852) to form a combined fracture initiation block and quality block separated into GG, GB, BG and BB classifications, defining (1856) stages using the combined composite quality index and merged fracture initiation blocks (1854), eliminating (1858) small stages where an interval is less than a minimum diverter assisted stage length, splitting (1860) large stages to form a plurality of stages where an interval is greater than a minimum diverter assisted length, selectively adjusting (1862) the stage boundaries to form uniform quality blocks and selectively positioning (1864) perforations based on the diverter assisted classifications.

Figure 19:
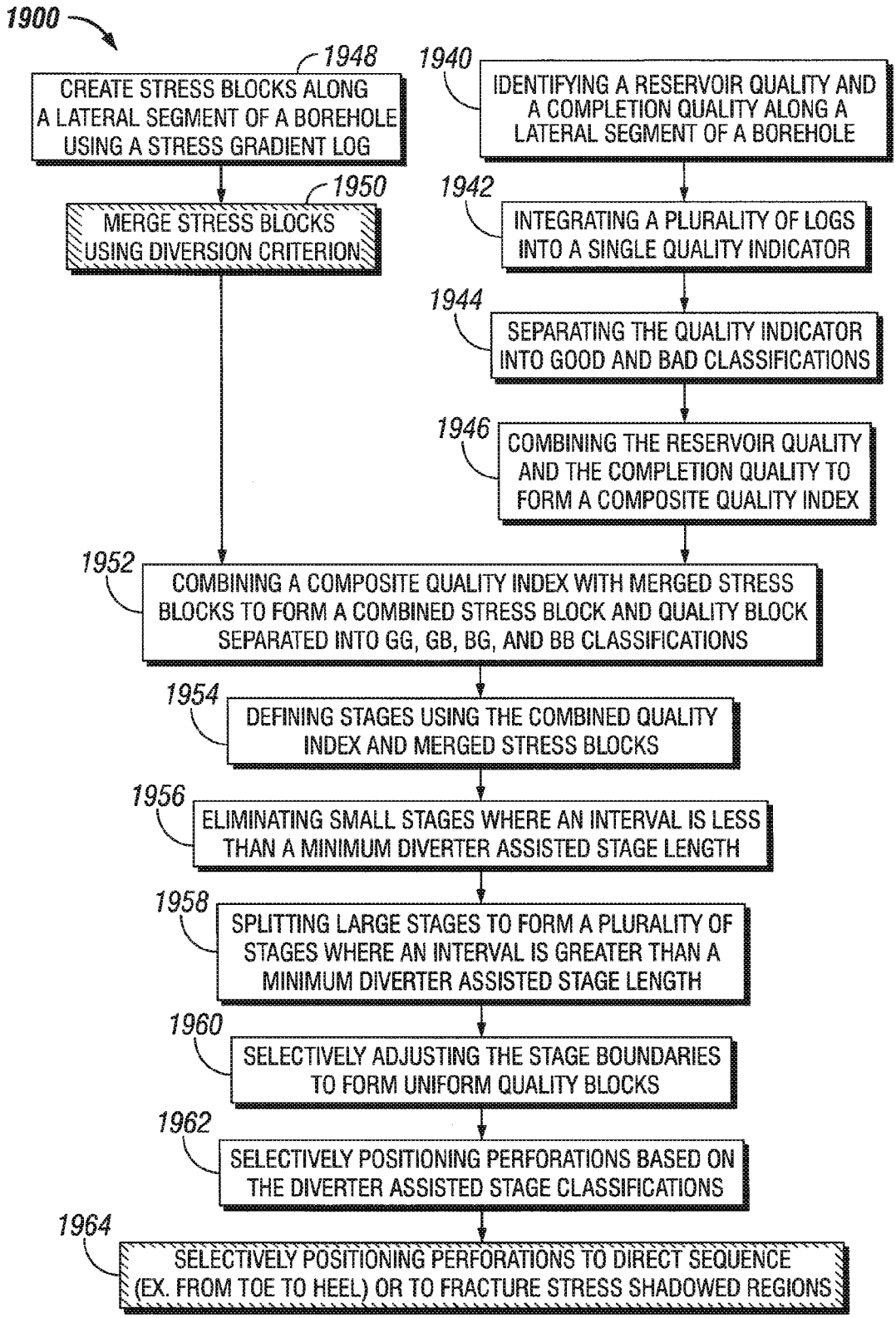
Figure 20:
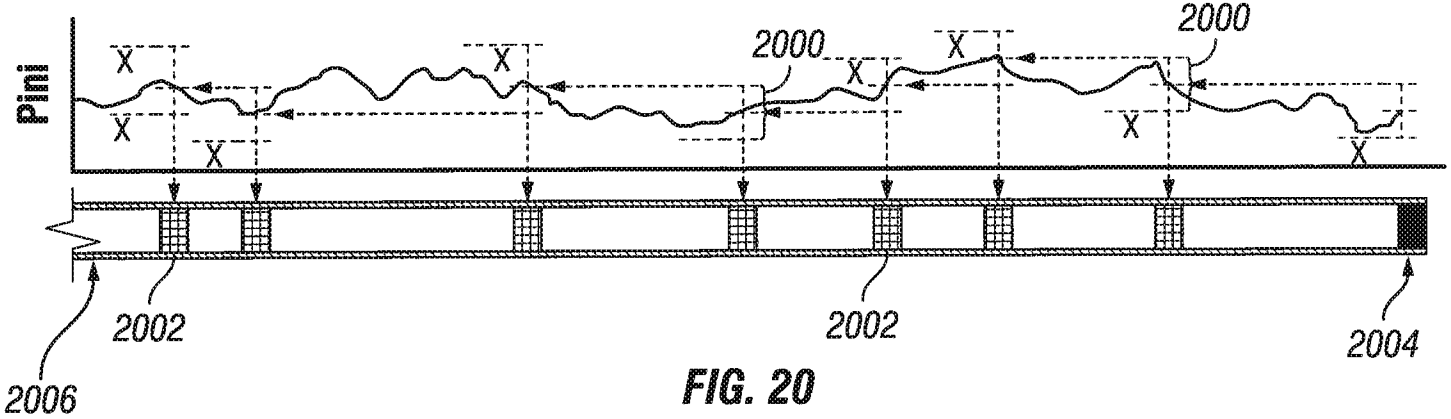
FIG. 20 is a diagram showing a continuum of stresses along the lateral (reported as fracture initiation pressure $P_{im}$) used for the determination of preferred locations of mechanical isolation devices based on the initiation pressure differential that can be overcome with the diverter.

FIG. 19 is a flow diagram illustrating a method (1900) of performing a diversion-assisted stimulation operation. The method involves identifying (1940) a reservoir quality indicator and a completion quality indicator along a lateral segment of a borehole, integrating (1942) a plurality of logs into a single quality indicator, separating (1944) the reservoir quality indicator into good and had classifications and combining (1946) the reservoir quality indicator and the completion quality indicator to form a composite quality index. Independently of the identifying (1940), integrating (1942), separating (1944) and combining (1946) steps, the method further involves creating (1948) stress blocks along as lateral segment of a borehole and merging (1950) the stress blocks using the diversion criterion discussed above in 1603. The method then further involves combining (1952) a composite quality index (1946) with the merged stress blocks (1950) to form a combined stress block and quality block separated into GG, GB, BG and BB classifications, defining (1954) stages using the combined composite quality index and merged stress block (1952), eliminating (1956) small stages where an interval is less than a minimum diverter assisted stage length, splitting (1958) large stages to form a plurality of stages where an interval is greater than a minimum diverter assisted length, selectively adjusting (1960) the stage boundaries to form uniform quality blocks and selectively positioning (1962) perforations based on the diverter assisted classifications. The method may also include as an optional step selectively positioning (1964) perforations to a direct sequence (e.g., from toe to heel) or to fracture stress shadowed regions. Mechanical isolation techniques, such as, for example, bridge plugs may be used to separate stress blocks selected as described above. Furthermore, selective positioning of the mechanical isolations could also be based on the sequential selection of stress block lengths in a suitable direction along a completion. For example, the direction may be a toe-to-heel arrangement as depicted in FIG. 20, which illustrates a continuum of stresses along the lateral (reported as fracture initiation pressure ($P_{im}$). FIG. 20 also shows a sequential determination of the suitable locations of the mechanical isolation 2002 devices based on the fracture initiation pressure differential 2000 ($\Delta P_{im}$) that can be overcome with the diverter. The sequential technique can be performed manually, semi-automatically or automatically, but can also be performed front any arbitrary point along the completion. In FIG. 20: Starting from the section to be fractured at the toe 2004 (right hand side of FIG. 20), and moving toward the heel 2006 (Following the arrow to the left side of FIG. 20), the $P_{im}$ log variations are compared with $\Delta P_{im}$. $\Delta P_{in}$ is the criterion described earlier (1605). Any variation of amplitude exceeding $\Delta P_{im}$ is to be isolated using a mechanical isolation device 2002 such as a bridge plug, which isolates a section of the wellbore independently front the stress variations of the formation. The advantage of such an approach is to use bridge plugs only where required by the stress variations.

Perforations can be located to impart a preferred direction to the sequence of clusters to be fractured (see FIG. 20). For example, if the stress variations are distributed such that lower stress regions are at the toe of the stage, then one may begin by perforating the low stress zones toward the toe of the stage, and then place the 'high stress perforations toward the heel of the stage. Using this method, the toe dusters will be fractured first and plugged by the diverter. After the diverter is placed, in the perforations, the heel clusters may then be fractured. One potential advantage of such a toe-to-heel scheme is if the amount of diverter pumped downhole is in excess for the number of fractures, then the excess diverter remains in the wellbore and downstream of the new dusters to be fractured. Therefore, the location of that "diverter in excess" may not inadvertently plug the new fractures which are being created in the high stress zones. This may happen if the job design overestimated the number of perforations which have been fractured prior to injecting a diverter Such overestimation can occur when the design overestimated the amount of perforations which have been fractured by as factor of 50%, and the actual pre-diversion treatment left half of the perforations unstimulated. Therefore, if 10 kg of diverter is used to plug effectively the actual fracture, but the design called for 20 kg of diverter, then there is a 10 kg, diverter excess that will be pumped in the wellbore. This excess amount of diverter should not accidentally plug the perforations to divert to, so it is desirable that the perforations to divert to are above the perforations to plug (i.e., toward the heel with respect to the old perforations). If the risk of inadvertently plugging perforations to divert to is perceived high, then one may decide not to use the diverter when the stress distribution is such that the low stress regions are located toward the heel of the stage.

Figure 21:
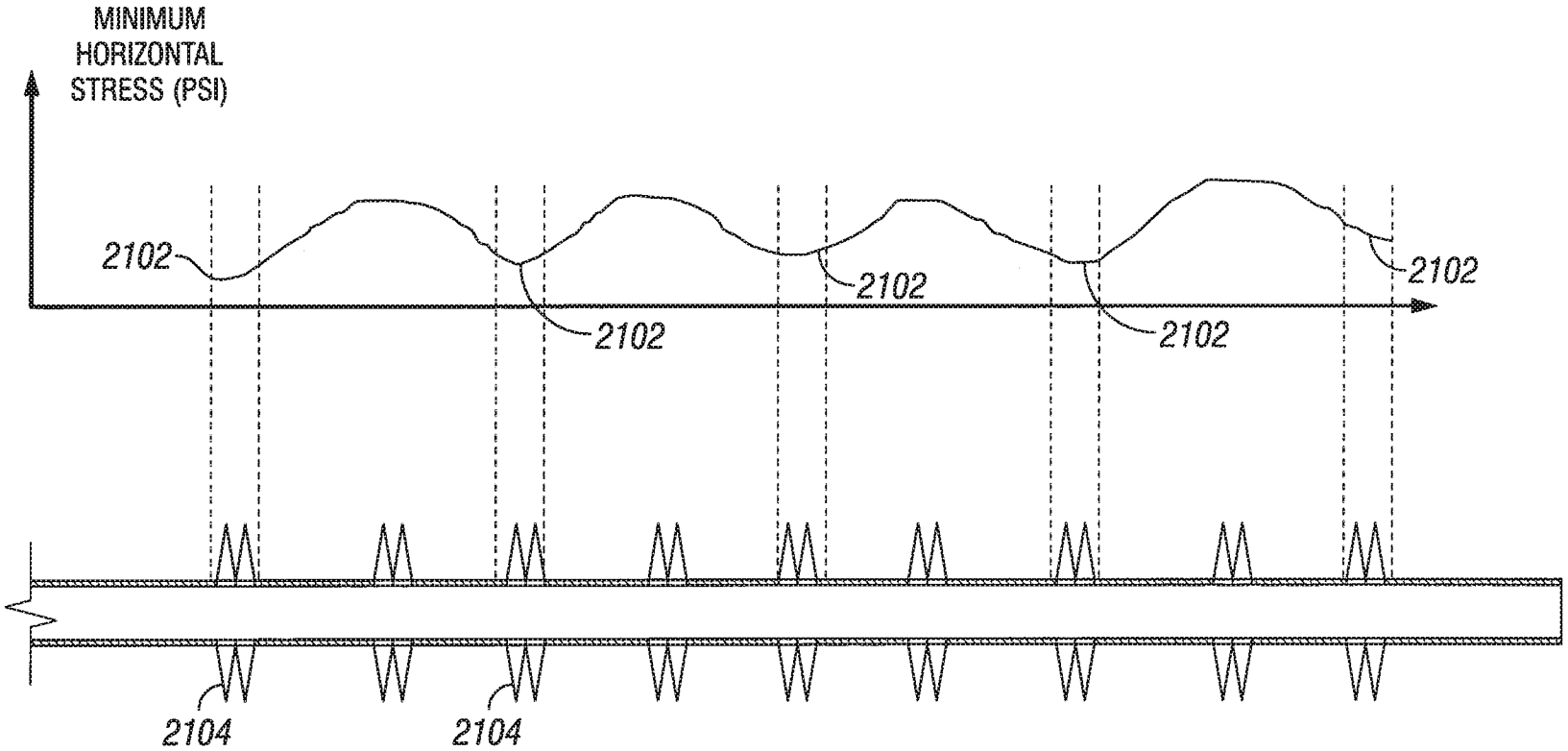
FIG. 21 is a wellbore and its corresponding stress log, where perforations are located at local minima and local maxima of the stress log.

Alternatively, as shown in FIG. 21, the perforation location 2104 may also be selected and/or located so that the perforations 2104 in low stress areas of the stress logs 2102 once stimulated and after diversion are perforations to be fractured in regions under the stress shadow of the perforations fractured initially. The differences in low stress and high stress are a function of the original stress anisotropy, rock geomechanical property and net pressure developed during the development of the induced fracture. A typical value for a difference in fracture gradient between the low and high stress regions is 0.2 psi/ft. Stress shadows are characterized by the situation when hydraulic fractures are placed in close proximity, the subsequent fractures may be affected by the stress field from the previous fractures. The effects include higher net pressures, smaller fracture widths and changes in the associated complexity of the stimulation. The level of microseismicity is also altered by stress shadow effects. Additional details regarding stress shadowing are described in SPE 147363, the disclosure of which is incorporated by reference herein in its entirety.

Figure 22:
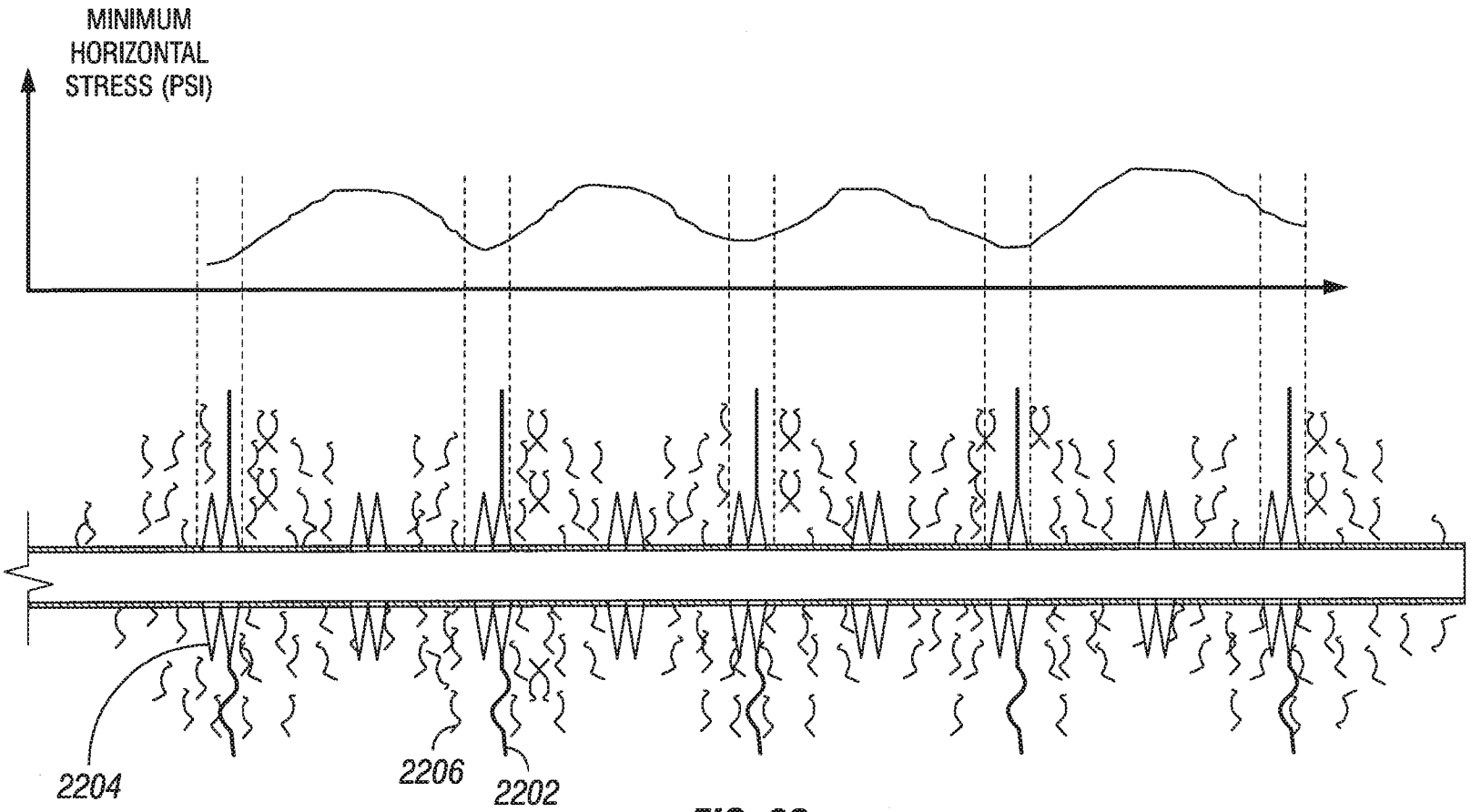
FIG. 22 is a stimulated wellbore and its corresponding stress log, where induced fractures have propagated in the zones of lower stress and where changes in stress of the rock have generated stress relief fractures.

In a reservoir with medium level of horizontal stress anisotropy, such as, for example, a first stage may initially open the low stress clusters creating bi-wing or low complexity fracture 2202 due to stress anisotropy. In brittle formations, the propagation of the bi-wing fractures 2202 can also cause parallel stress relief fractures 2206. Such bi-wing fractures 2202 are presented in FIG. 22, where perforations 2204 connected to the low stress zones are being fractured.

The induced fractures induce an altered stress field in the surrounding formation. The stress perpendicular to the fractures may change by a larger degree than the stress parallel to the fracture, thereby reducing the stress contrast. Stress anisotropy can be reduced or even reversed to facilitate openings of planes of weakness within the rock.

Figure 23:
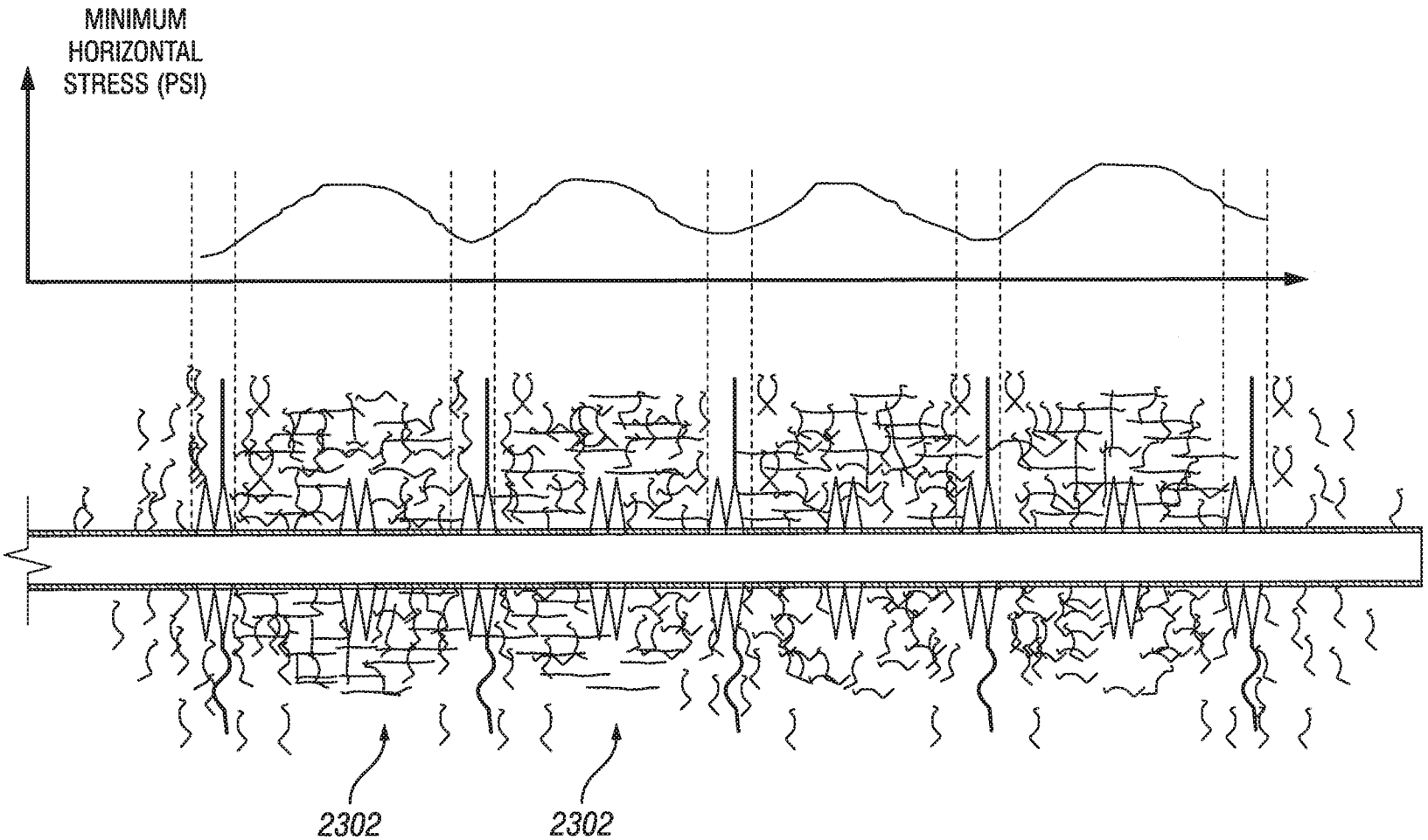
FIG. 23 is a stimulated wellbore and its corresponding stress log, where induced fractures have been diverted from and perforations in high stress regions have been stimulated to thrill complex fractures.

Pumping the diverter obstructs the fractures. A second part of pumping after diversion will initiate fracturing in the higher stress clusters in areas of the rock that would be altered by the stress shadow of the $1^{st}$ stage. Those stress-altered regions have a lower, or inverted stress anisotropy and therefore the dilation of the existing natural fracture or shear failure of planes of weakness. Therefore these fractures would likely be more complex (i.e., for a complex fracture network 2302) giving a better connection with hydrocarbon remaining in the formation. See FIG. 23. Method to determine the spacing between fractures for generating stress-altered complex fracturing is described SPE130043 and U.S. Pat. No. 8,439,116 B2, each of which is incorporated by reference herein in its entirety.

An individual using the diverter-assisted completion advisor may decide to compare the results of the simulation with a diverter and without the diverter. Because the diverter enables merging stress blocks, the diverter assisted algorithm tends to show that the length of each section isolated with bridge plugs is in general longer than without diverter. The engineer may also chose a higher value of max stage length based on the simulation results, Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

In a given example, a stimulation operation may be performed involving evaluating variability of reservoir properties and completion properties separately for a treatment interval in a wellbore penetrating a subterranean formation, partitioning the treatment interval into a set of contiguous intervals (both reservoir and completion properties may be similar within each partitioned treatment interval, designing a stimulation treatment scenario by using a set of planar geometric objects (discrete fracture network) to develop a 3D reservoir model, and combining natural fracture data with the 3D reservoir model to account heterogeneity of formation and predict hydraulic fracture progressions.

What is claimed is:

1. A method for staging a stimulation operation for a wellsite having a reservoir positioned in a subterranean formation, comprising:

generating from measured wellsite data a plurality of quality indicators from a plurality of logs;

using modeling techniques to combine the plurality of quality indicators to form a composite quality indicator;

merging a plurality of stress blocks using diversion criterion;

using modeling techniques to combine the composite quality indicator with the merged stress blocks to form a combined stress block and composite quality indicator, the combined stress block and composite quality indicator comprising a plurality of blocks with boundaries therebetween;

defining stages along the combined stress and composite quality indicator based on diverter-assisted stage classifications; and perforating a wellbore at select stages based on the diverter-assisted stage classifications thereon.

2. The method of claim 1, wherein the generating comprises measuring downhole parameters with a downhole tool positioned in a wellbore at the wellsite.

3. The method of claim 1, wherein the generating comprises generating a reservoir quality indicator by combining a plurality of reservoir logs and generating a completions quality indicator by combining a plurality of completions logs.

4. The method of claim 3, wherein the plurality of reservoir logs and the plurality of completions logs comprise a plurality of resistivity logs, permittivity logs, productions logs and combinations thereof.

5. The method of claim 1, wherein the diverter-assisted stage classifications comprise one of good, bad and combinations thereof.

6. The method of claim 1, further comprising selectively adjusting the stage boundaries.

7. The method of claim 6, wherein the selectively adjusting comprises selectively eliminating the plurality of blocks that are less than a minimum diverter-assisted stage length.

8. The method of claim 6, wherein the selectively adjusting comprises splitting the plurality of blocks having a length greater than a minimum diverter assisted stage length.

9. The method of claim 6, wherein the selectively adjusting comprises selectively shifting boundaries based on the diverter assisted classifications.

10. The method of claim 1, wherein the merging further comprises:

creating a plurality of stress blocks;

computing fracture initiation pressure using one or more of well properties, near-wellbore properties and the plurality of stress logs; and merging fracture initiation blocks using the diversion criterion.

11. The method of claim 10, wherein the merged stress blocks are the merged fracture initiation blocks.

12. The method of claim 1, wherein the perforating further comprises selecting positioning the perforations to impart a direction to the fracturing sequence.

13. The method of claim 1, wherein the perforating further comprises selectively positioning the perforations to fracture stress shadowed regions of the formation.

* * * * *